US008904600B2

(12) United States Patent
Sugasawara et al.

(10) Patent No.: US 8,904,600 B2
(45) Date of Patent: Dec. 9, 2014

(54) HINGE APPARATUS AND CONTAINER APPARATUS

(75) Inventors: Jun Sugasawara, Tokyo (JP); Kazuyoshi Oshima, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 272 days.

(21) Appl. No.: 13/057,305

(22) PCT Filed: Aug. 10, 2009

(86) PCT No.: PCT/JP2009/003839

§ 371 (c)(1),
(2), (4) Date: May 3, 2011

(87) PCT Pub. No.: WO2010/018683

PCT Pub. Date: Feb. 18, 2010

(65) Prior Publication Data

US 2011/0204072 A1 Aug. 25, 2011

(30) Foreign Application Priority Data

Aug. 12, 2008 (JP) ..... 2008-207747
Mar. 19, 2009 (JP) ..... 2009-067763

(51) Int. Cl.
*E05D 3/06* (2006.01)
*E05D 15/34* (2006.01)

(52) U.S. Cl.
CPC ..... *E05D 15/34* (2013.01); *E05Y 2201/21* (2013.01); *E05Y 2201/256* (2013.01); *E05Y 2201/264* (2013.01); *E05Y 2201/604* (2013.01); *E05Y 2201/62* (2013.01); *E05Y 2201/638* (2013.01); *E05Y 2201/686* (2013.01); *E05Y 2201/688* (2013.01); *E05Y 2900/20* (2013.01)
USPC ..... 16/366; 16/288; 16/370

(58) Field of Classification Search
USPC ..... 16/366, 368–370, 286–288, 302, 235, 16/242, 49, 82, 239, 382; 312/326, 138.1; 220/810, 817, 827, 830
See application file for complete search history.

(56) References Cited

U.S. PATENT DOCUMENTS 4,091,498 A * 5/1978 Lautenschlager ..... 16/235
5,035,026 A * 7/1991 Carlo et al. ..... 16/288

(Continued)

FOREIGN PATENT DOCUMENTS

JP H02-007185 U 1/1990
JP 2004-124455 A 4/2004

(Continued)

OTHER PUBLICATIONS

International Search Report for PCT/JP2009/003839 mailed Oct. 27, 2009 (2 pages).

(Continued)

*Primary Examiner* — William Miller
(74) *Attorney, Agent, or Firm* — Osha Liang LLP

(57) ABSTRACT

A hinge apparatus has a first attachment member to be attached to a housing, a second attachment member to be attached to a door; and first and second links, respective basal end portions of the first and the second links rotatably attached to the first attachment member, respective distal end portions of the first and the second links rotatably attached to the second attachment member. The first attachment member, the second attachment member, the first link and the second link constitute a link mechanism. The first attachment member has a base member to be attached to the housing, and a connecting member removably attached to the base member. The basal end portions of the first and the second links are rotatably attached to the connecting member. The connecting member, the second attachment member, the first link and the second link constitute a link mechanism.

17 Claims, 26 Drawing Sheets

(56) References Cited

U.S. PATENT DOCUMENTS

| | | | | |
|---|---|---|---|---|
| 5,058,238 | A * | 10/1991 | Lautenschlager | 16/278 |
| 6,859,979 | B2 * | 3/2005 | Egger et al. | 16/327 |
| 7,275,284 | B2 * | 10/2007 | Lautenschlager et al. | 16/287 |
| 7,406,749 | B2 * | 8/2008 | Herper | 16/368 |
| 7,886,408 | B2 * | 2/2011 | Lautenschlager | 16/286 |
| 8,225,459 | B2 * | 7/2012 | Waltemate et al. | 16/366 |

FOREIGN PATENT DOCUMENTS

| | | | |
|---|---|---|---|
| JP | 2004-225451 | A | 8/2004 |
| JP | 2005-240465 | A | 9/2005 |

OTHER PUBLICATIONS

Japanese Office Action for Japanese Application No. 2008-207747, dated Oct. 4, 2011, and English translation thereof (6 pages).

Japanese Office Action for Japanese Application No. 2009-067763, dated Oct. 4, 2011, and English translation thereof (6 pages).

Japanese Office Action for Japanese Application No. 2008-207747, dated Jul. 12, 2011, and English translation thereof (7 pages).

Japanese Office Action for Japanese Application No. 2009-067763, dated Jul. 19, 2011, and English translation thereof (7 pages).

* cited by examiner

HINGE APPARATUS AND CONTAINER APPARATUS

TECHNICAL FIELD

The present invention relates to a hinge apparatus and a container apparatus in which the hinge apparatus is used.

BACKGROUND ART

As mentioned in the Patent Documents 1 and 2 listed below, a container apparatus such as a container box generally includes a housing having an opening in a front surface thereof, a door that opens and closes the opening of the housing and a hinge apparatus that rotatably connects the door to the housing. The hinge apparatus includes a first attachment member attached to an inner side surface of the housing and a second attachment member attached to the door. The first attachment member and the second attachment member are rotatably connected to each other via first and second links. By this arrangement, the door is rotatably supported by the housing via the hinge apparatus, and the door is rotatable between a closed position in which the door closes the opening of the housing and an open position in which the opening is open.

PRIOR ART DOCUMENTS

Patent Documents

Patent Document 1: Japanese Patent Application Publication No. 2004-124455

Patent Document 2: Japanese Patent Application Publication No. 2005-240465

SUMMARY OF INVENTION

Technical Problem

In a conventional hinge apparatus used in the container apparatus, a length of a first link and a length of a second link are different from each other. Therefore, while a door is parallel to a front surface of a housing when the door is in a closed position, the door is inclined or orthogonal with respect to the front surface of the housing when the door is in an open position. This means that while the door is moved from the closed position to the open position, the door is rotated about one end portion of the door on the hinge apparatus side with the other end portion of the door moved forward. Therefore, a space large enough to allow the door to be rotated therein is required in front of the housing. Especially when a length of the door in a left-right direction is long, a large space is required. For this reason, there arises a problem that when there is not enough space in front of the housing, the door cannot be sufficiently open.

Moreover, in the container apparatus, an utilizable inner space of the housing is narrowed to a great degree by the hinge apparatus. Therefore, there has been a demand for the development of a hinge apparatus and a container apparatus that can realize a wider effectively utilizable inner space in the housing.

Solution to Problem

To solve the former of the two problems mentioned above, a first aspect of the present invention provides a hinge apparatus comprising:

a first attachment member to be attached to a housing;

a second attachment member to be attached to a door; and first and second links, respective basal end portions of the first and the second links rotatably attached to the first attachment member, respective distal end portions of the first and the second links rotatably attached to the second attachment member;

wherein the first attachment member, the second attachment member, the first link and the second link constitute a parallel link mechanism.

In this case, it is preferable that the first attachment member comprises:

a base member to be attached to the housing; and a connecting member removably attached to the base member;

wherein the basal end portions of the first and the second links are rotatably attached to the connecting member; and the connecting member, the second attachment member, the first link and the second link constitute a parallel link mechanism.

It is preferable that the hinge apparatus further comprises a third link that constitutes a parallel link mechanism with the connecting member, the second attachment member, the first link and the second link;

wherein a rotation center of a basal end portion of the third link with respect to the connecting member is arranged to form a triangle with rotation centers of the first and the second links with respect to the connecting member. In this arrangement, support strength of the first, the second and the third links supporting the door can be enhanced.

It is preferable that the first, the second and the third links are bent in respective intermediate portions; and bent portions of the first, the second and the third links are positioned on a same side with respect to straight lines connecting the respective rotation centers of the respective basal end portions of the first, the second and the third links and the respective rotation centers of the respective distal end portions of the first, the second and the third links. In this arrangement, when the door is moved to an open position, an interference of the first, the second and the third links on the housing can be prevented. In other words, the door can be opened wider by a degree corresponding to a prevented amount of the interference of the first, the second and the third links on the housing.

It is preferable that the connecting member comprises an attachment plate portion, the basal end portions of the first to the third links rotatably attached to the attachment plate portion;

two links of the first to the third links are disposed on one side of the attachment plate portion and the other link is disposed on the other side of the attachment plate portion; and one link of the two links is disposed generally in contact with the attachment plate portion and the other link is disposed such that the other link is in contact with the attachment plate portion via a spacer having a thickness equal to or greater than a thickness of the one link so that the other link does not interfere with the one link. In this arrangement, the first, the second and the third links can be prevented from interfering with each other when the links are rotated.

It is preferable that a housing side adjustment mechanism that adjusts an attitude of the connecting member about an axis parallel to the rotation centers of the first to the third links is disposed between the base member and the connecting member;

the second attachment member comprises:

a base part to be attached to the door; and a support part attached to the base part, the distal end portions of the first to the third links rotatably attached to the support part; and a door side adjustment mechanism that adjusts an attitude of the support part about an axis parallel to the rotation centers of the first to the third links is disposed between the base part and the support part. In this arrangement, an attitude of the door about an axis parallel to the rotation centers of the first, the second and the third links can be adjusted by at least one of the housing side adjustment mechanism and the door side adjustment mechanism. Especially when the attitude of the door is adjusted by the door side adjustment mechanism, the attitude of the door can be adjusted without taking out an article contained in the housing.

It is preferable that the housing side adjustment mechanism adjusts the attitude of the connecting member by rotating one end portion of the connecting member, the first to the third links being connected to the one end portion of the connecting member, about the other end portion of the connecting member. In this arrangement, when the connecting member is rotated, the attitude of the door is changed, and moreover, the one end portion of the connecting member is displaced in a direction of parallel displacement of the second attachment member. Therefore, in a case where there is an error in an attachment position of the door with respect to the direction of parallel displacement, the error can be corrected by rotating the connecting member. However, the correction of error is accompanied by a change in the attitude of the door. Even so, the attitude of the door that has been changed can be adjusted by the door side adjustment mechanism and the door can be brought back to an original, correct position. It is preferable that a housing side adjustment mechanism that adjusts an attitude of the connecting member about an axis parallel to the rotation centers of the first and the second links is disposed between the base member and the connecting member;

the second attachment member comprises:

a base part to be attached to the door; and a support part attached to the base part, the distal end portions of the first and the second links rotatably attached to the support part; and a door side adjustment mechanism that adjusts an attitude of the support part about an axis parallel to the rotation centers of the first and the second links is disposed between the base part and the support part. In this arrangement, an attitude of the door about an axis parallel to the rotation centers of the first and the second links can be adjusted by at least one of the housing side adjustment mechanism and the door side adjustment mechanism. Especially when the attitude of the door is adjusted by the door side adjustment mechanism, the attitude of the door can be adjusted without taking out an article contained in the housing. Especially in this case it is preferable that the housing side adjustment mechanism adjusts the attitude of the connecting member by rotating one end portion of the connecting member, the first and the second links being connected to the one end portion of the connecting member, about the other end portion of the connecting member. In this arrangement, when the connecting member is rotated, the attitude of the door is changed, and moreover, the one end portion of the connecting member is displaced in the direction of parallel displacement of the second attachment member. Therefore, in a case where there is an error in an attachment position of the door with respect to the direction of parallel displacement, the error can be corrected by rotating the connecting member. However, the correction of error is accompanied by a change in the attitude of the door. Even so, the attitude of the door that has been changed can be adjusted by the door side adjustment mechanism and the door can be brought back to an original, correct position.

It is preferable that the hinge apparatus further comprises rotationally biasing means that rotationally biases the first link in one direction such that the second attachment member is translated further in one direction when the second attachment member is translated in the one direction with respect to the first attachment member and reaches a predetermined position. In this arrangement, in a case where the one direction is a closing direction of the door, for example, when the door is moved from the open position side to a closed position side and the door reaches a position a predetermined distance before the closed position, the door can be moved to the closed position by the rotationally biasing means.

It is preferable that the rotationally biasing means comprises:

an arm, one end portion of the arm rotatably connected to the second attachment member, the other end portion of the arm displaceably connected to the first link such that the other end portion is rotated about the one end portion accompanying the rotation of the first link;

a cam portion disposed in the second attachment member;

a movable member disposed in the arm such that the movable member can be moved in directions towards and away from the cam portion; and a biasing member that presses the movable member into contact with the cam portion; and wherein a biasing force of the biasing member is converted into a rotationally biasing force by the movable member and the cam portion abutted against each other, the rotationally biasing force rotating the first link in the one direction. In this arrangement, by arranging the arm parallel to the first link and disposing the biasing member in the arm, the hinge apparatus can be downsized.

To solve the former of the two problems mentioned above, a second aspect of the present invention provides a container apparatus comprising:

a housing having an opening;

a door that opens and closes the opening of the housing; and a hinge apparatus that connects the door to the housing such that the door can be moved between a closed position in which the door closes the opening and an open position in which the opening is open, the hinge apparatus comprising:

a first attachment member attached to an inner surface of the housing;

a second attachment member attached to a rear surface of the door; and first and second links, respective basal end portions of the first and the second links rotatably attached to the first attachment member, respective distal end portions of the first and the second links rotatably attached to the second attachment member;

wherein the first attachment member, the second attachment member, the first link and the second link constitute a parallel link mechanism.

In this case it is preferable that the first attachment member comprises a base member attached to the inner surface of the housing and a connecting member removably attached to the base member;

the basal end portions of the first and the second links are rotatably attached to the connecting member; and the connecting member, the second attachment member, the first link and the second link constitute a parallel link mechanism.

It is preferable that the container apparatus further comprises a third link that constitutes a parallel link mechanism with the connecting member, the second attachment member, the first link and the second link;

wherein a rotation center of a basal end portion of the third link with respect to the connecting member is arranged to form a triangle with rotation centers of the first and the second links with respect to the connecting member. In this arrangement, support strength of the first, the second and the third links supporting the door can be enhanced.

It is preferable that one of three portions of the connecting member to which the first to the third links are rotatably connected is protruded outside from the opening of the housing; and a recess is formed in the rear surface of the door, the portion of the connecting member protruded from the opening entering into the recess when the door is in the closed position or in the vicinity of the closed position. In this arrangement, when the door is moved to the closed position, the first, the second and the third links enter inside the housing. However, a depth of the first, the second and the third links entering into the housing can be reduced by a depth corresponding to the portion of the connecting member protruded to the outside from the opening of the housing, and thereby an effectively utilizable space inside the housing can be widened. Moreover, since the protruded portion of the connecting member enters the recess, an interference of the portion on the door can be prevented.

It is preferable that the first, the second and the third links are bent in respective intermediate portions; and bent portions of the first, the second and the third links are positioned on a same side with respect to straight lines connecting the respective rotation centers of the respective basal end portions of the first, the second and the third links and the respective rotation centers of the respective distal end portions of the first, the second and the third links. In this arrangement, when the door is moved to an open position, an interference of the first, the second and the third links on the housing can be prevented. In other words, the door can be opened wider by a degree corresponding to a prevented amount of the interference of the first, the second and the third links on the housing.

It is preferable that the connecting member comprises an attachment plate portion, the basal end portions of the first to the third links rotatably attached to the attachment plate portion;

two links of the first to the third links are disposed on one side of the attachment plate portion and the other link is disposed on the other side of the attachment plate portion; and one link of the two links is disposed generally in contact with the attachment plate portion and the other link is disposed such that the other link is in contact with the attachment plate portion via a spacer having a thickness equal to or greater than a thickness of the one link so that the other link does not interfere with the one link. In this arrangement, the first, the second and the third links can be prevented from interfering with each other when the first, the second and the third links are rotated.

It is preferable that a housing side adjustment mechanism that adjusts an attitude of the connecting member about an axis parallel to the rotation centers of the first to the third links is disposed between the base member and the connecting member;

the second attachment member comprises:

a base part to be attached to the door; and a support part attached to the base part, distal end portions of the first to the third links rotatably attached to the support part; and a door side adjustment mechanism that adjusts an attitude of the support part about an axis parallel to the rotation centers of the first to the third links is disposed between the base part and the support part. In this arrangement, an attitude of the door about an axis parallel to the rotation centers of the first, the second and the third links can be adjusted by at least one of the housing side adjustment mechanism and the door side adjustment mechanism. Especially when the attitude of the door is adjusted by the door side adjustment mechanism, the attitude of the door can be adjusted without taking out an article contained in the housing.

It is preferable that the housing side adjustment mechanism adjusts the attitude of the connecting member by rotating one end portion of the connecting member, the first to the third links being connected to the one end portion, about the other end portion of the connecting member. In this arrangement, when the connecting member is rotated, the attitude of the door is changed, and moreover, the one end portion of the connecting member is displaced in a direction of parallel displacement of the second attachment member. Therefore, in a case where there is an error in an attachment position of the door with respect to the direction of parallel displacement, the error can be corrected by rotating the connecting member. However, the correction of error is accompanied by a change in the attitude of the door. Even so, the attitude of the door that has been changed can be adjusted by the door side adjustment mechanism and the door can be brought back to an original, correct position.

It is preferable that a housing side adjustment mechanism that adjusts an attitude of the connecting member about an axis parallel to the rotation centers of the first and the second links is disposed between the base member and the connecting member;

the second attachment member comprises:

a base part to be attached to the door; and a support part attached to the base part, the distal end portions of the first and the second links rotatably attached to the support part; and a door side adjustment mechanism that adjusts an attitude of the support part about an axis parallel to the rotation centers of the first and the second links is disposed between the base part and the support part. In this arrangement, an attitude of the door about an axis parallel to the rotation centers of the first and the second links can be adjusted by at least one of the housing side adjustment mechanism and the door side adjustment mechanism. Especially when the attitude of the door is adjusted by the door side adjustment mechanism, the attitude of the door can be adjusted without taking out an article contained in the housing. Especially in this case it is preferable that the housing side adjustment mechanism adjusts the attitude of the connecting member by rotating one end portion of the connecting member, the first and the second links being connected to the one end portion of the connecting member, about the other end portion of the connecting member. In this arrangement, when the connecting member is rotated, the attitude of the door is changed, and moreover, the one end portion of the connecting member is displaced in a direction of parallel displacement of the second attachment member. Therefore, in a case where there is an error in an attachment position of the door with respect to the direction of parallel displacement, the error can be corrected by rotating the connecting member. However, the correction of error is accompanied by a change in the attitude of the door. Even so, the attitude of the door that has been changed can be adjusted by the door side adjustment mechanism and the door can be brought back to an original, correct position.

It is preferable that the container apparatus further comprises rotationally biasing means that rotationally biases the first link in one direction such that the second attachment member is translated further in the one direction when the second attachment member is translated in the one direction with respect to the first attachment member and reaches a predetermined position. In this arrangement, in a case where the one direction is a closing direction of the door, for example, when the door is moved from the open position side to a closed position side and the door reaches a position a predetermined distance before the closed position, the door can be moved to the closed position by the rotationally biasing means.

It is preferable that the rotationally biasing means comprises:

an arm, one end portion of the arm rotatably connected to the second attachment member, the other end portion of the arm displaceably connected to the first link such that the other end portion is rotated about the one end portion accompanying the rotation of the first link;

a cam portion disposed in the second attachment member;

a movable member disposed in the arm such that the movable member can be moved in directions towards and away from the cam portion; and a biasing member that presses the movable member into contact with the cam portion; and wherein a biasing force of the biasing member is converted into a rotationally biasing force by the movable member and the cam portion abutted against each other, the rotationally biasing force rotating the first link in the one direction. In this arrangement, by arranging the arm parallel to the first link and disposing the biasing member in the arm, the hinge apparatus can be downsized.

To solve the latter of the two problems mentioned above, a third aspect of the present invention provides a hinge apparatus comprising:

a first attachment member having a flat first attachment surface;

first and second links, basal end portions of the first and the second links rotatably connected to the first attachment member such that respective basal end portions of the first and the second links are rotatable about a first rotation shaft and a second rotation shaft parallel to the first rotation shaft; and a second attachment member having a flat second attachment surface, distal end portions of the first and the second links being connected to the second attachment member such that the first and the second links are respectively rotatable about third and fourth rotation shafts parallel to the first and second rotation shafts, thereby connecting the second attachment member to the first attachment member via the first and the second links such that the second attachment member can be rotated between a closed position and an open position;

when the second attachment member is in the closed position, an angle between the first attachment surface and the second attachment surface being generally a right angle, the first to the fourth rotation shafts being positioned on the same side as the second attachment surface with respect to the first attachment surface, and the third and the fourth rotation shafts being more distanced from the first attachment surface than the first and the second rotation shafts;

wherein when the second attachment member is in the closed position, an entirety or most part of the first attachment surface is positioned on one side with respect to the second attachment surface and at least one of the first and the second rotation shafts is positioned on the opposite side from the entirety or the most part of the first attachment surface with respect to the second attachment surface.

To solve the latter of the two problems mentioned above, a fourth aspect of the present invention provides a hinge apparatus comprising:

a first attachment member having a flat first attachment surface;

first and second links, basal end portions of the first and the second links rotatably connected to the first attachment member such that the respective basal end portions of the first and the second links are respectively rotatable about a first rotation shaft and a second rotation shaft parallel to the first rotation shaft; and a second attachment member having a flat second attachment surface, distal end portions of the first and the second links being connected to the second attachment member such that the first and the second links are respectively rotatable about third and fourth rotation shafts parallel to the first and second rotation shafts, thereby connecting the second attachment member to the first attachment member via the first and the second links such that the second attachment member can be rotated between a closed position and an open position;

when the second attachment member is in the closed position, an angle between the first attachment surface and the second attachment surface being generally a right angle, the first to the fourth rotation shafts being positioned on the same side as the second attachment surface with respect to the first attachment surface, and the third and the fourth rotation shafts being more distanced from the first attachment surface than the first and the second rotation shafts;

wherein the first rotation shaft and the second rotation shaft are disposed such that when the second attachment member is in the closed position, one of the first rotation shaft and the second rotation shaft is positioned on one side with respect to the second attachment surface and the other of the first rotation shaft and the second rotation shaft is positioned on the opposite side with respect to the second attachment surface.

In the third and the fourth aspects, it is preferable that the first rotation shaft and the second rotation shaft are disposed such that when the second attachment member is in the closed position, one of the first rotation shaft and the second rotation shaft is positioned on the one side and the other of the first rotation shaft and the second rotation shaft is positioned on the opposite side.

It is preferable that the first attachment member, the first link, the second link and the second attachment member constitute a parallel link mechanism; and a center distance between the first rotation shaft and the third rotation shaft and a center distance between the second rotation shaft and the fourth rotation shaft are set to be longer than a center distance between the first rotation shaft and the second rotation shaft.

To solve the latter of the two problems mentioned above, a fifth aspect of the present invention provides a container apparatus comprising:

a housing having an opening formed in an one end portion outer surface of the housing; and a door connected to the housing via a hinge apparatus such that the door can be rotated between a closed position and an open position;

the hinge apparatus comprising:

a first attachment member attached to an inner surface of the housing at a portion near the one end portion outer surface of an one side inner surface of the inner surface of the housing;

first and second links, basal end portions of the first and the second links rotatably attached to the first attachment member such that the respective basal end portions of the first and the second links are rotatable about a first rotation shaft and a second rotation shaft parallel to the first rotation shaft; and a second attachment member attached to a rear surface of the door and connecting the door to the housing such that the door can be rotated between the closed position and the open position, the second attachment member being connected to respective distal end portions of the first and the second links such that the second attachment member can be rotated about third and fourth rotation shafts parallel to the first and the second rotation shafts;

the first attachment member being attached to the one side inner surface, when the door is in the closed position, the second attachment member being positioned nearer to the other side portion than the first attachment member in a direction from the one side inner surface to the other side portion;

wherein at least one of the first and the second rotation shafts are disposed further outside than the inner surface of the housing.

In this case, at least one of the first and the second rotation shafts may be disposed further in front than the one end portion outer surface of the housing, the opening formed in the outer surface. The at least one of the first and the second rotation shafts may be disposed further outside than the one side inner surface of the housing, the first attachment member attached to the one side inner surface. Alternatively, the at least one of the first and the second rotation shafts may be disposed further outside than an outer surface adjacent to the one side inner surface of the housing, the first attachment member attached to the one side inner surface. Alternatively, a notch portion may be formed in an intersecting portion of the one end portion outer surface of the housing and the one side inner surface of the housing, the opening formed in the one end portion outer surface, the first attachment member attached to the one side inner surface; and at least one of the first and the second rotation shafts may be disposed inside the notch portion.

In a case where at least one of the first and the second rotation shafts are disposed further in front than the one end portion outer surface of the housing, the opening formed in the outer surface, and the rear surface of the door is abutted against the one end portion outer surface of the housing, the opening formed in the one end portion outer surface, when the door is in the closed position, it is preferable that a recess is formed in the rear surface of the door, the first rotation shaft being received in the recess in an extendable and retractable manner when the door is in the closed position.

It is preferable that the first attachment member, the first link, the second link and the second attachment member constitute a parallel link mechanism; and a center distance between the first rotation shaft and the third rotation shaft and a center distance between the second rotation shaft and the fourth rotation shaft are set to be longer than a center distance between the first rotation shaft and the second rotation shaft.

Advantageous Effects of Invention

According to the first and the second aspects of the present invention having the above-mentioned constructions, since the first attachment member, the second attachment member, the first link and the second link constitute a parallel link mechanism, the door is translated between the closed position and the open position without being rotated about one end portion of the door on the hinge apparatus side. Therefore, the other end portion of the door is not moved forward. Thus, a space large enough to allow the door to be rotated therein is not required in front of the housing. The door can be sufficiently opened and closed even when the space is narrow.

According to the third, the fourth and the fifth aspects of the present invention having the above-mentioned constructions, since at least one of the first rotation shaft and the second rotation shaft is disposed further outside than the inner surface of the housing, the first attachment member can be disposed near the end surface of the housing in which the opening is formed. Accordingly, the first link and the second link can also be disposed on the opening side of the housing. Therefore, the effectively utilizable inner space of the housing can be widened.

DESCRIPTION OF EMBODIMENTS

A best mode for carrying out the present invention will be described hereinafter with reference to the drawings.

Figure 1:
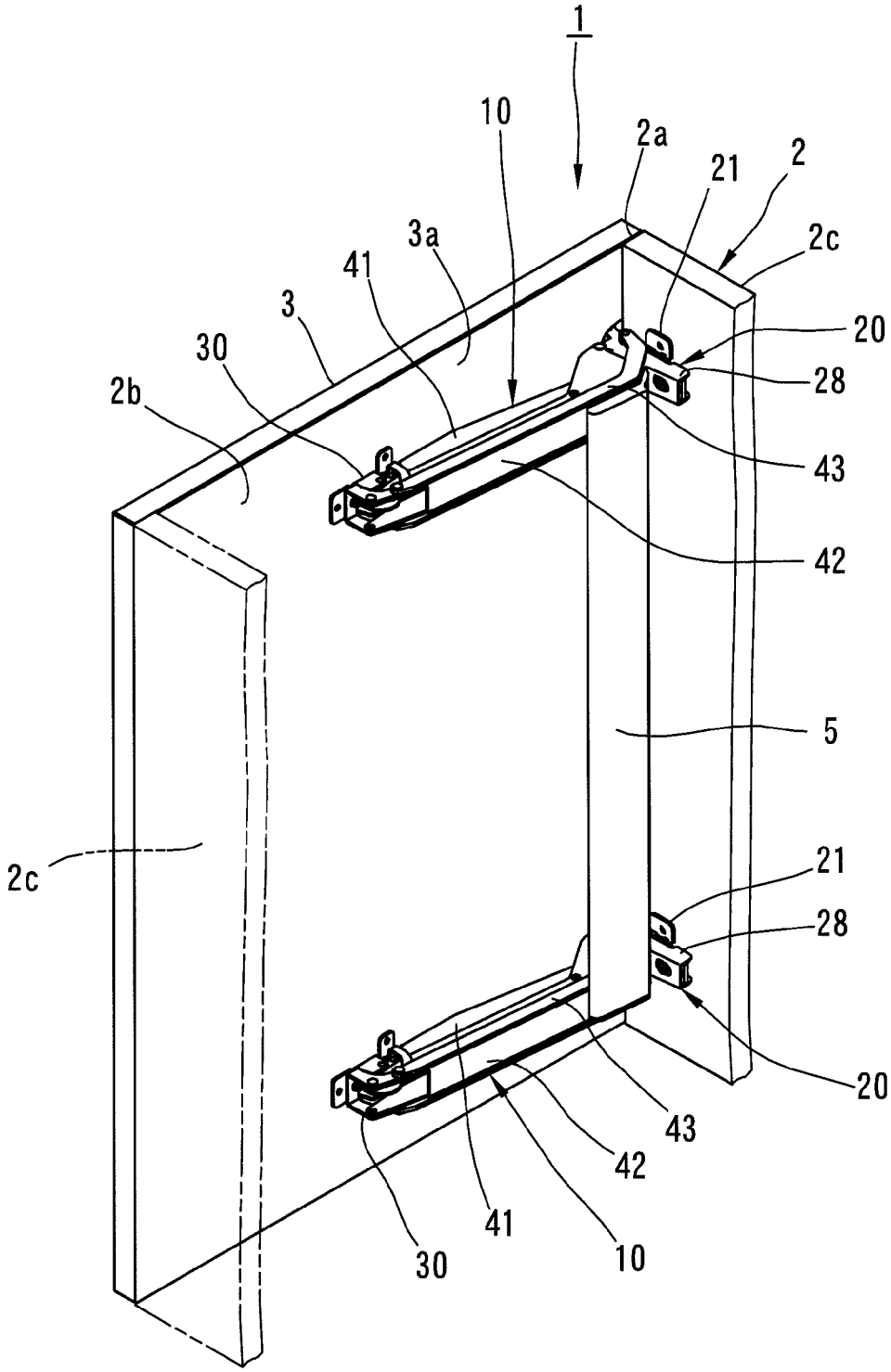
FIG. 1 is a perspective view of a main portion of a first embodiment of a container apparatus according to the present invention when a door is in a closed position.
Figure 2:
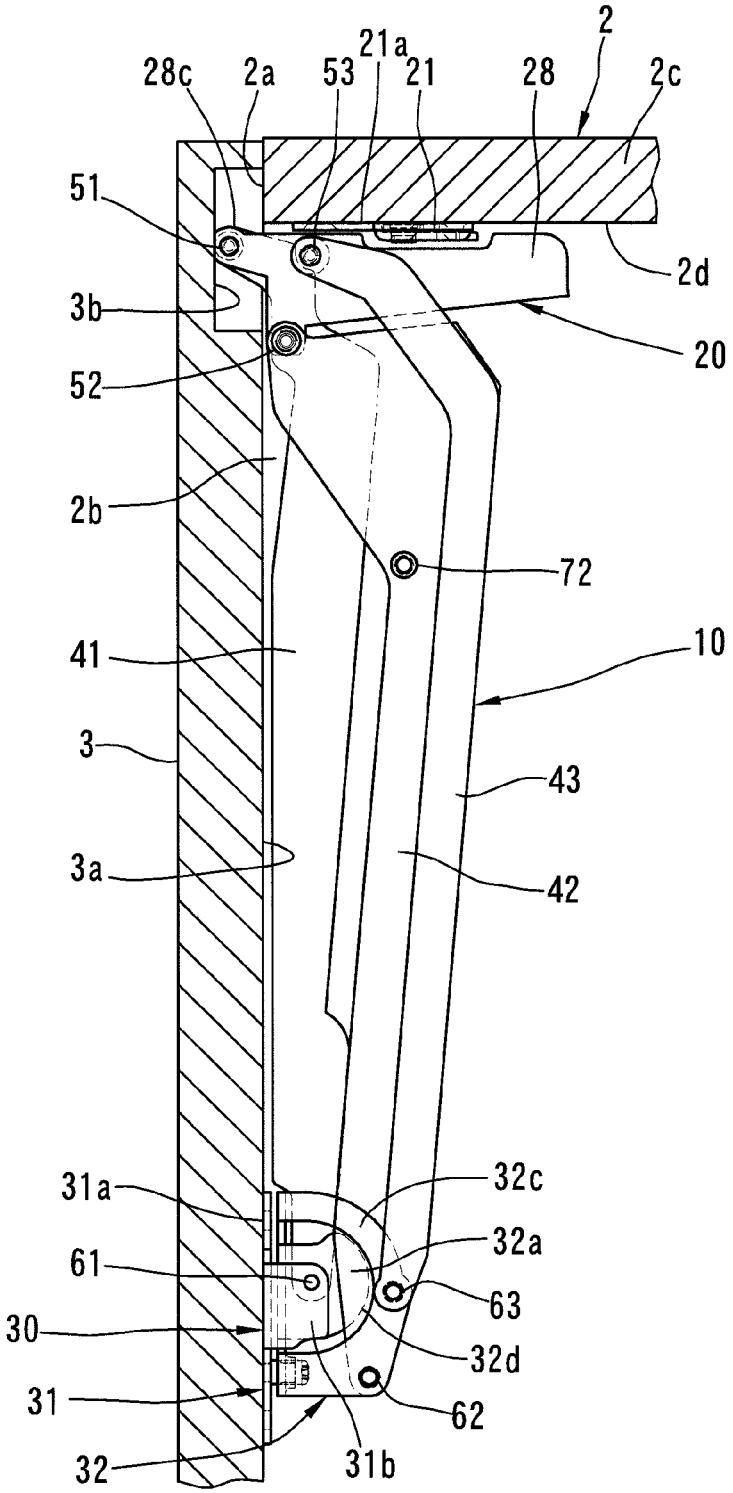
FIG. 2 is a plan cross-sectional view of the main portion of the first embodiment when the door is in the closed position.
Figure 3:
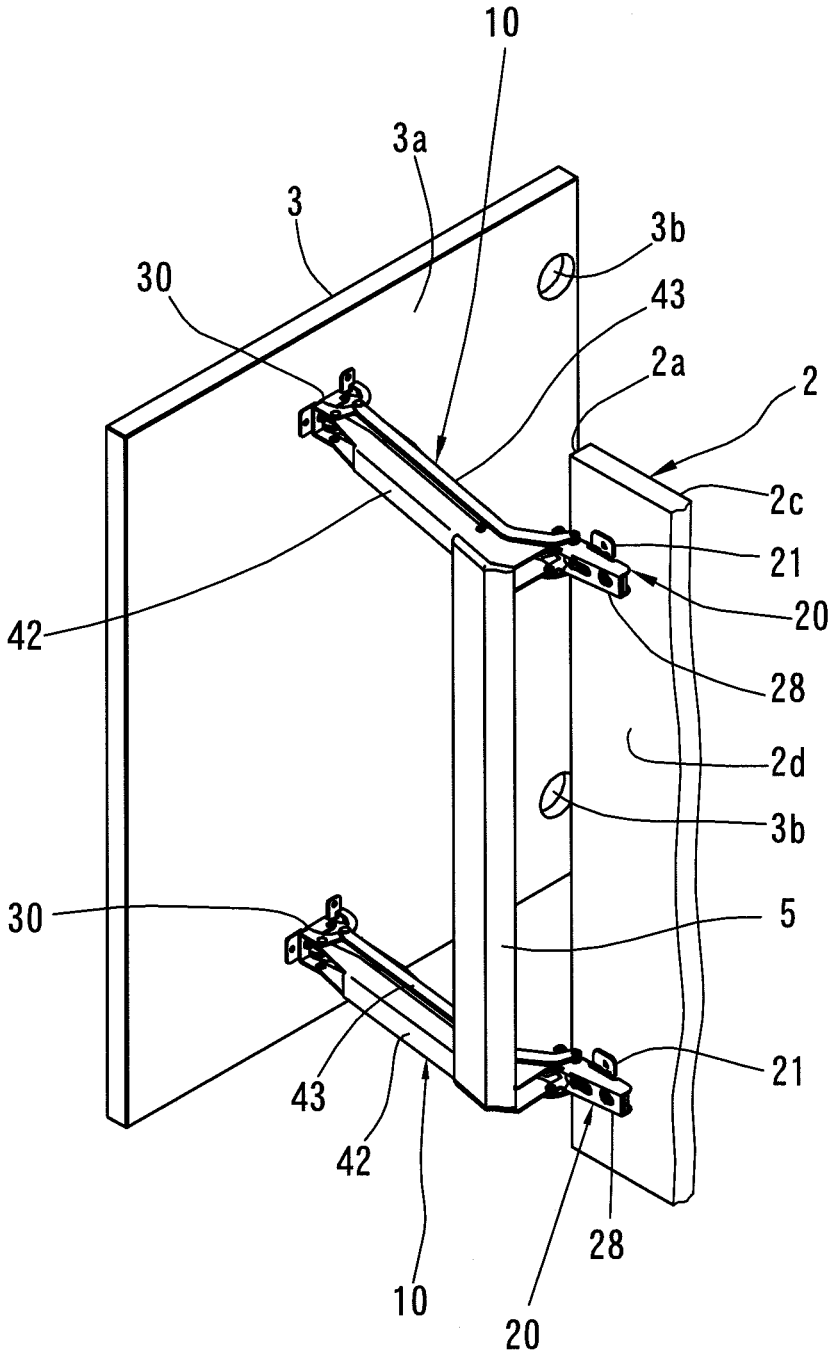
FIG. 3 is a perspective view of the main portion of the first embodiment when the door is in an intermediate position between the closed position and an open position.
Figure 4:
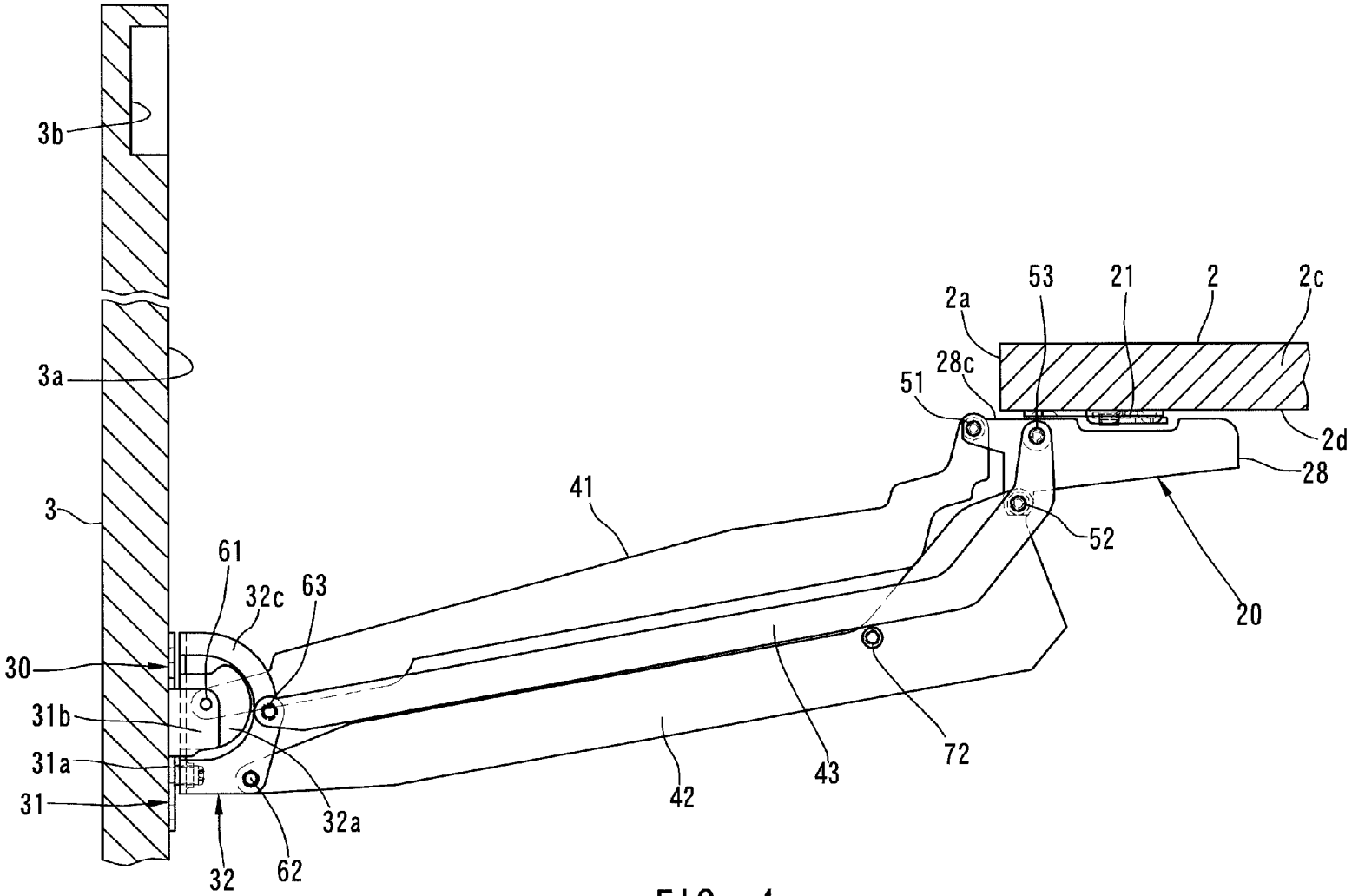
FIG. 4 is a plan cross-sectional view of the main portion of the first embodiment when the door is in the intermediate position between the closed position and the open position.
Figure 5:
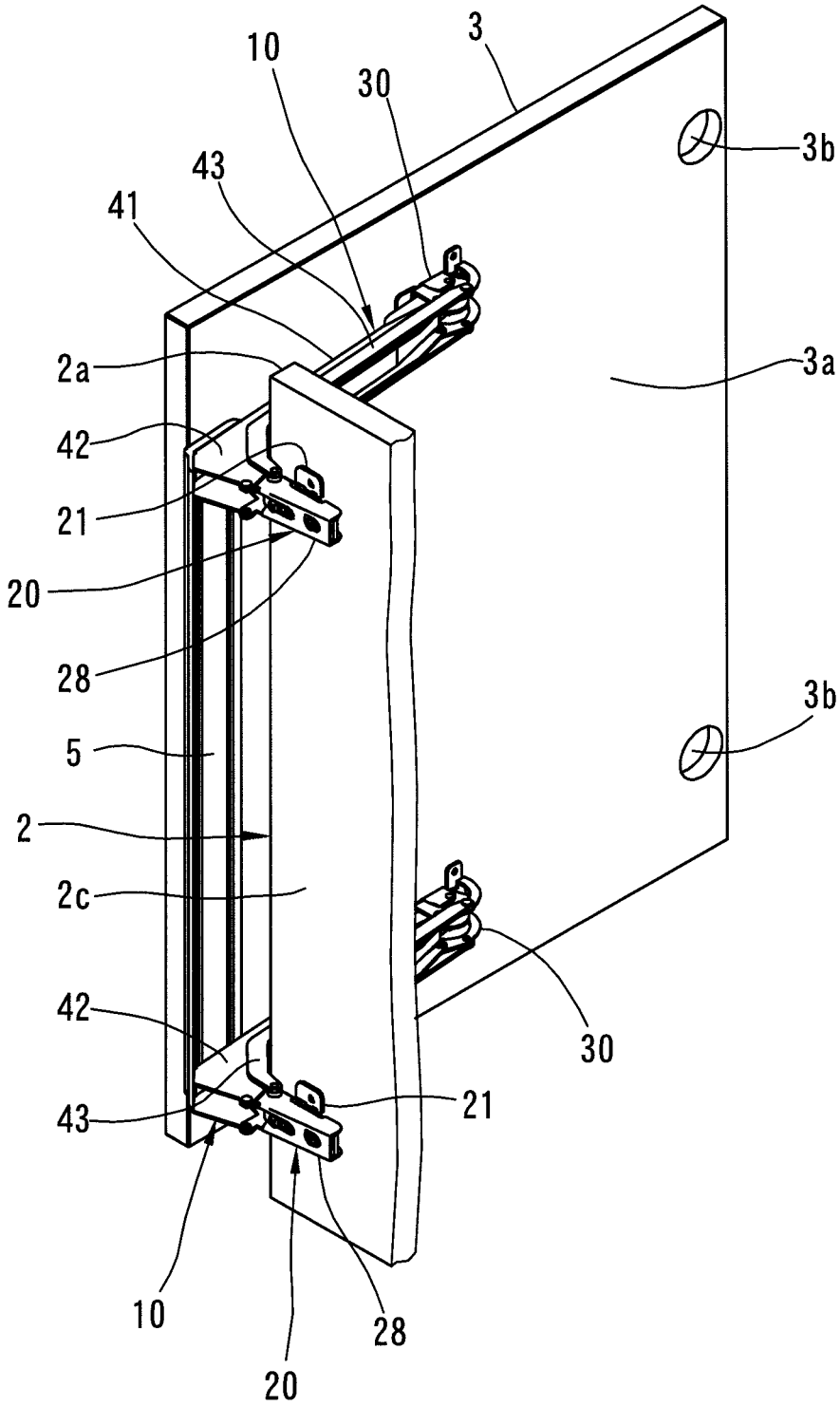
FIG. 5 is a perspective view of the main portion of the first embodiment when the door is in the open position.
Figure 6:
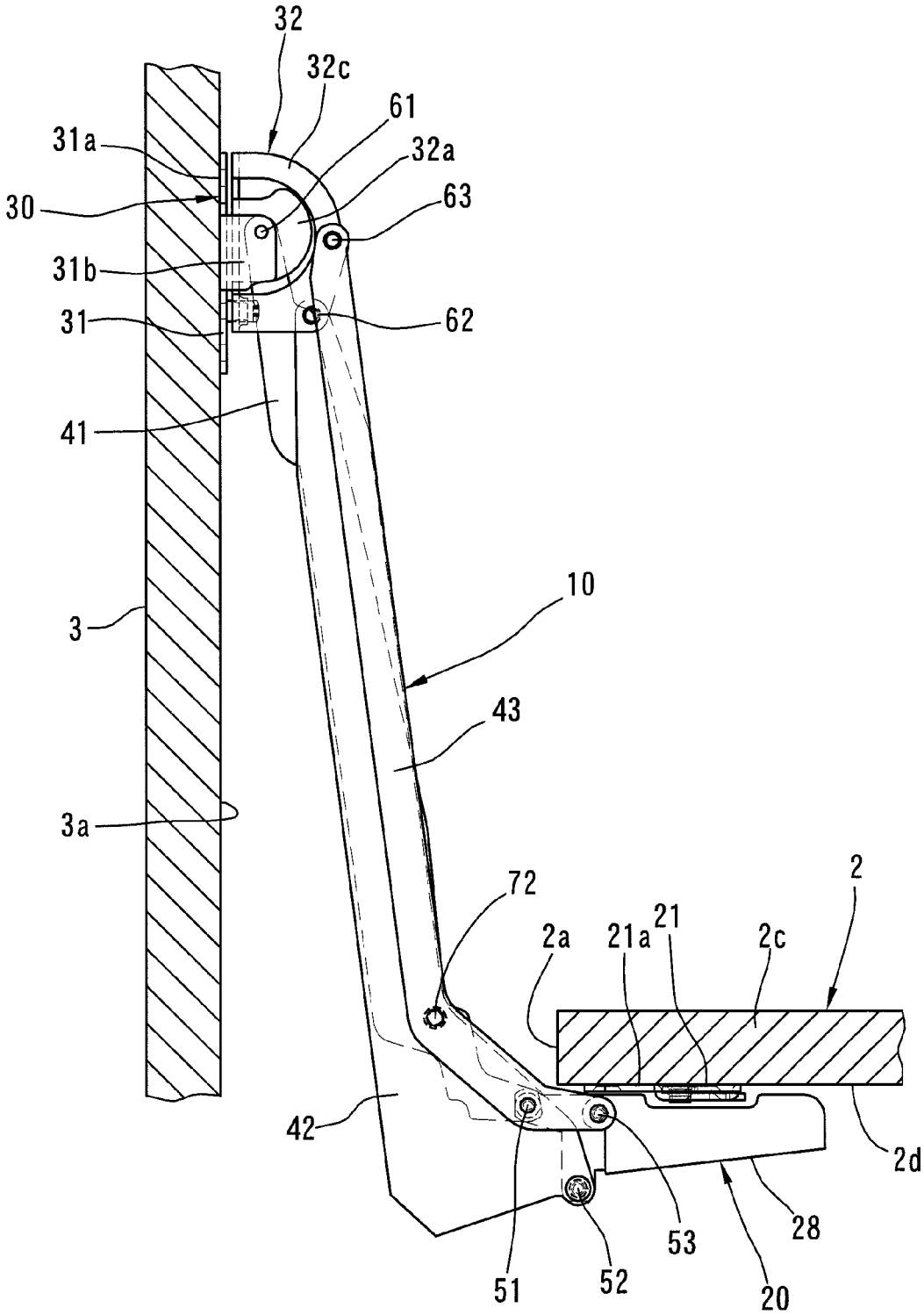
FIG. 6 is a plan cross-sectional view of the main portion of the first embodiment when the door is in the open position.

FIGS. 1, 3 and 5 are perspective views of a main portion of a container apparatus according to the present invention. FIGS. 2, 4 and 6 are plan cross-sectional views of the main portion of the container apparatus. As shown in these drawings, the container apparatus 1 includes a housing 2, a door 3 and an upper hinge apparatus 10 and a lower hinge apparatus 10.

The housing 2 has a configuration of a quadrangular box having an opening 2*b* formed in a vertical front surface 2*a* of the housing 2. Instead of having the opening 2*b* formed in the front surface 2*a*, the housing 2 may have an opening formed in either one of vertical side surfaces of the housing 2 in the left or right or in a horizontal top surface of the housing 2.

The door has a flat plate configuration and has a vertical rear surface 3*a*. The door 3 is supported by the housing 2 via the upper and lower hinge apparatus 10, 10 such that the door 3 is rotatable in a horizontal direction. The door 3 can be rotated (translated) between a closed position shown in FIGS. 1 and 2 and an open position shown in FIGS. 5 and 6 via an intermediate position shown in FIGS. 3 and 4. The closed position of the door 3 is defined by the abutment of the rear surface 3*a* of the door 3 against the front surface 2*a* of the housing 2. The intermediate position and the open position of the door 3 are determined by the hinge apparatus 10 as will be described later.

The hinge apparatus 10 includes a first attachment member 20, a second attachment member 30 and first, second and third links 42, 43, 41 disposed between the first attachment member 20 and the second attachment member 30.

The first attachment member 20 includes a base plate 21 as shown particularly in FIGS. 15 to 18. A first attachment surface 21*a* having a flat surface configuration is formed in the base plate 21. The first attachment surface 21*a* is surface-contacted with a one side inner surface of an inner surface of the housing 2. The one side inner surface is a vertical inner side surface (one side inner surface) 2*d* of either one of the left and right side walls 2*c* of the housing 2 (the side wall in the left when viewed form a front of the housing 2 in this embodiment). With the first attachment surface 21*a* in this condition, the base plate 21 is fixed to the housing 2, and thereby the first attachment member 20 is attached to the housing 2. The base plate 21 is disposed near the front surface 2*a*. Therefore, the first attachment member 20 is also disposed near the front surface 2*a*.

Figure 17:
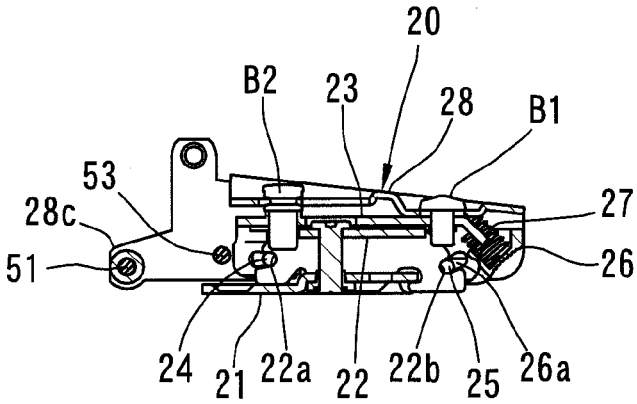
FIG. 17 is a cross-sectional view along line X-X of FIG. 16.
Figure 18:
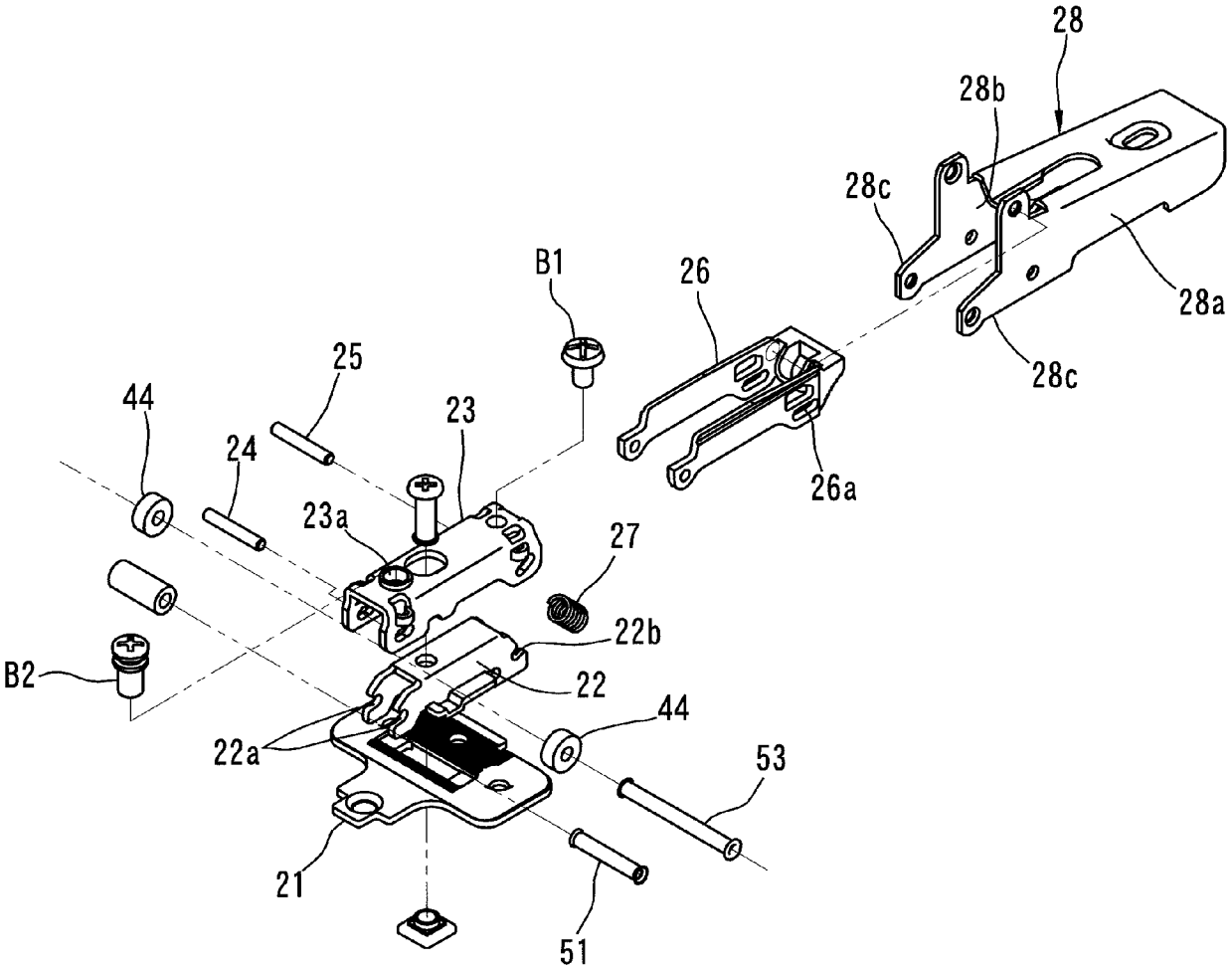
FIG. 18 is an exploded perspective view of the first attachment member.
Figure 19:
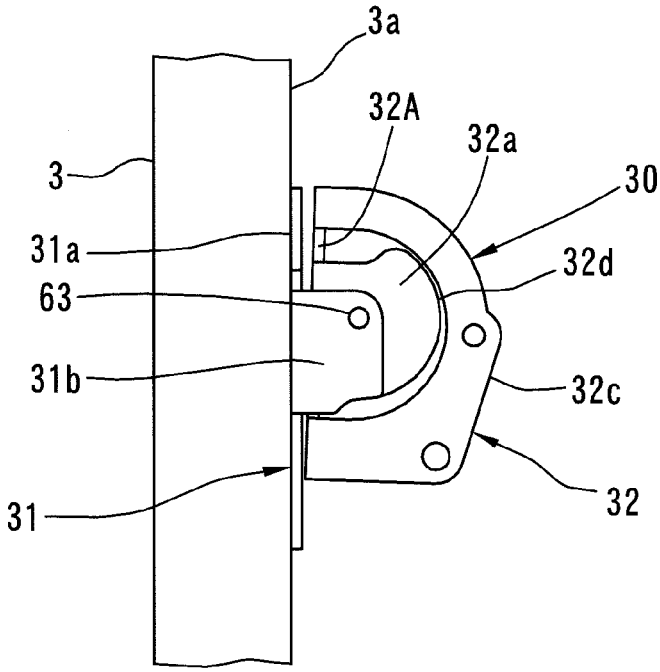
FIG. 19 is a plan view of the hinge apparatus with a second attachment member attached to the door.
Figure 20:
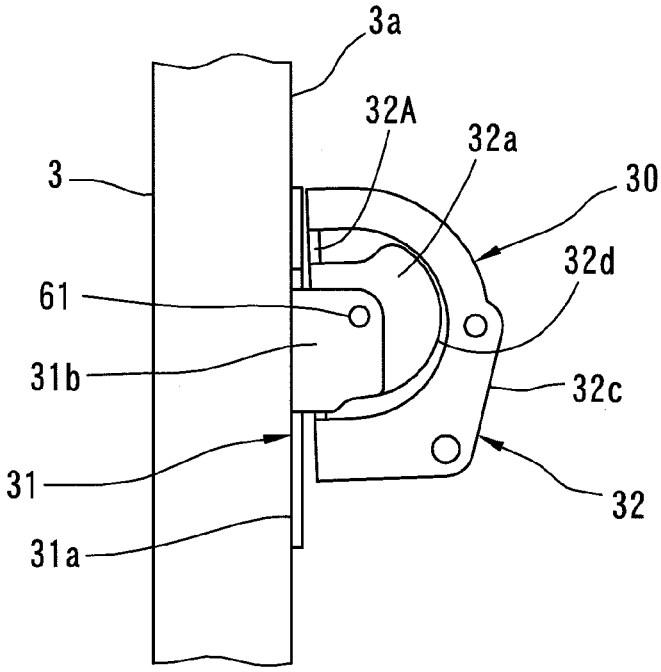
FIG. 20 is a plan view of the second attachment member with an attitude of a support part with respect to a base part different from an attitude shown in FIG. 19.

A height adjustment member 22 is attached to the base plate 21 such that a location of the height adjustment member 22 can be adjusted in a top-bottom direction (direction orthogonal to the plane of FIG. 17). The height adjustment member 22 has a generally U-shaped cross-sectional configuration. The height adjustment member 22 is attached to the base plate 21 with a longitudinal direction thereof oriented in a front-rear direction and with an open portion thereof opposed to the base plate 21. A mounting member 23 is removably attached to the height adjustment member 22. The mounting member 23 has a U-shaped cross-sectional configuration and is disposed such that the mounting member 23 covers the height adjustment member 22. Engagement shafts 24, 25 extending in the top-bottom direction are disposed in front and rear end portions of the mounting member 23. The engagement shafts 24, 25 are respectively disengageably engaged with engagement recesses 22*a*, 22*b* formed in front and rear end portions of the height adjustment member 22, and thereby the mounting member 23 is detachably attached to the height adjustment member 22.

A disengagement member 26 is used for removing the mounting member 23 from the height adjustment member 22. The disengagement member 26 is formed in a generally U-shaped configuration in plan view such that the disengagement member 26 surrounds upper and lower side portions and a rear end portion of the mounting member 23. A front end portion of the disengagement member 26 is rotatably attached to the front end portion of the mounting member 23 via the engagement shaft 24. An elongated hole 26*a* is formed in a rear end portion of the disengagement member 26. The engagement shaft 25 is inserted in the elongated hole 26*a* such that the engagement shaft 25 can be moved in a longitudinal direction of the elongated hole 26*a*. The rear end portion of the disengagement member 26 is biased from the rear end portion of the mounting member 23 toward the base plate 21 by a spring 27. The engagement shafts 24, 25 are respectively brought into engagement with the engagement recesses 22*a*, 22*b* by a biasing force of the spring 27, and thereby the mounting member 23 is attached to the height adjustment member 22. To remove the mounting member 23 from the height adjustment member 22, the rear end portion of the disengagement member 26 is moved in a direction away from the base plate 21 against the biasing force of the spring 27, thereby causing the disengagement member 26 to be rotated about the engagement shaft 24. This causes the engagement shaft 25 to be disengaged from the engagement recess 22*b*. As a result, the mounting member 23 can be removed from the height adjustment member 22. The mounting member 23 can be attached to the height adjustment member 22 by bringing the engagement shaft 24 into engagement with the engagement recess 22*a* and rotating the mounting member 23 about the engagement shaft 24 such that the rear end portion of the mounting member 23 approaches the height adjustment member 22 or by bringing the engagement shaft 25 into engagement with the engagement recess 22*b* and rotating the mounting member 23 about the engagement shaft 25 such that the front end portion of the mounting member 23 approaches the height adjustment member 22.

A connecting member 28 is attached to the mounting member 23. The connecting member 28 has a U-shaped cross-sectional configuration and includes a pair of side plate portions (attachment plate portions) 28*a*, 28*b* that are parallel to each other and opposed to each other in the top-bottom direction. The connecting member 28 is disposed with a longitudinal direction thereof oriented in the front-rear direction. The connecting member 28 receives the mounting member 23 and the disengagement member 26 in an inside thereof. A rear end portion of the connecting member 28 can be position-adjusted with respect to the mounting member 23 in the front-rear direction (left-right direction in FIG. 17). The rear end portion of the connecting member 28 is fixed to the mounting member 23 by, after the position adjustment, tightening a bolt B1 threadedly engaged with the mounting member 23 through the connecting member 28. On the other hand, a front end portion of the connecting member 28 can be position-adjusted with respect to the mounting member 23 in a left-right direction (top-bottom direction in FIG. 17). A bolt B2 having a longitudinal direction thereof oriented in the left-right direction is inserted in the front end portion of the connecting member 28 such that the bolt B2 is rotatable but non-movable in the left-right direction. The bolt B2 is threadedly engaged with a screw hole 23*a* of the mounting member 23. Therefore, when the bolt B2 is rotated in one and the other directions, the front end portion of the connecting member 28 is rotated about the rear end portion of the connecting member 28 (the rear end portion of the connecting member 28 located at a same place with a head of the bolt B1 in the front-rear direction) in a horizontal direction. The front end portion of the connecting member 28 is moved in the left-right direction according to an amount of rotation thereof. When the bolt B2 is rotated in one direction, the front end portion of the connecting member 28 is moved in a direction away from the mounting member 23 (upward in FIG. 16); and when the bolt B2 is rotated in the other direction, the front end portion of the connecting member 28 is moved about the rear end portion of the connecting member 28 in a direction approaching the mounting member 23 (downward in FIG. 16). As is clear from the foregoing, the bolt B2 and the screw hole 23*a* constitute a housing side adjustment mechanism that rotates the front end portion of the connecting member 28 about the rear end portion of the connecting member 28.

Since the connecting member 28 is attached to the mounting member 23, the mounting member 23 is attached to the height adjustment member 22 and the height adjustment member 22 is attached to the base plate 21, the connecting member 28 can be position-adjusted with respect to the base plate 21 in the top-bottom direction and in the front-rear direction. Furthermore, the front end portion of the connecting member 28 can be position-adjusted in the left-right direction. This feature is known in the art as is disclosed in the Patent Application Publication No. H10-238199. Therefore, further description about this feature is omitted.

The second attachment member 30 includes a base part 31 and a support part 32 as shown particularly in FIG. 14 and FIGS. 19 to 23. The base part 31 has a flat plate configuration and a second attachment surface 31*a* having a flat surface configuration is formed in the base part 31. The base part 31 is press-fixed to the rear surface 3*a* of the door 3 by fixing means such as a bolt (not shown) with the second attachment surface 31*a* surface-contacted with the rear surface 3*a* of the door 3, and thereby the second attachment member 30 is attached to the door 3. The second attachment member 30 is located at generally the same location with the first attachment member 20 in the top-bottom direction and in a generally central portion of the rear surface 3*a* in the horizontal direction. Therefore, as shown in FIG. 2, when the door 3 is in the closed position, the second attachment member 30 is spaced from the first attachment member 20 in a direction (downward in FIG. 2) from the inner side surface 2*d* to the other inner side surface opposed to the inner side surface 2*d*.

A pair of protruded plate portions 31*b*, 31*b* (only one of the protruded plate portions 31*b* is shown) are formed in the base part 31. The protruded plate portion 31*b* is raised at a right angle to the rear surface 3*a*. Therefore, when the door 3 is in the closed position, the protruded plate portion 31*b* is protruded toward an interior of the housing 2 further than the front surface 2*a*. In other words, the protruded plate portion 31*b* is protruded rearward. Moreover, the pair of protruded plate portions 31*b*, 31*b* are arranged to be opposed to each other in the top-bottom direction.

The support part 32 has a flat plate portion 32A. The flat plate portion 32A is disposed such that the flat plate portion 32A is spaced from the base part 31 in a direction to the housing 2 by a predetermined distance, 2 to several millimeters, for example, and is opposed to the base part 31 in the front-rear direction (when the door 3 is in the closed position). A pair of cam plate portions 32*a*, 32*a* are formed in the flat plate portion 32A. The pair of cam plate portions 32*a*, 32*a* are formed such that the pair of cam plate portions 32*a*, 32*a* are bent at a right angle from the flat plate portion 32A toward the housing 2 and are opposed to each other in the top-bottom direction. The pair of cam plate portions 32*a*, 32*a* are inserted between the protruded plate portions 31*b*, 31*b*. Moreover, outer surfaces of the pair of cam plate portions 32*a*, 32*a* are generally in contact with inner surfaces (opposing surfaces) of the pair of protruded plate portions 31*b*, 31*b*. The cam plate portions 32*a*, 32*a* are connected to the protruded plate portions 31*b*, 31*b* so as to be rotatable in the horizontal direction by a rotation shaft (third rotation shaft) 61 extended through the protruded plate portions 31*b*, 31*b* and the cam plate portions 32*a*, 32*a* in the top-bottom direction.

Figure 13:
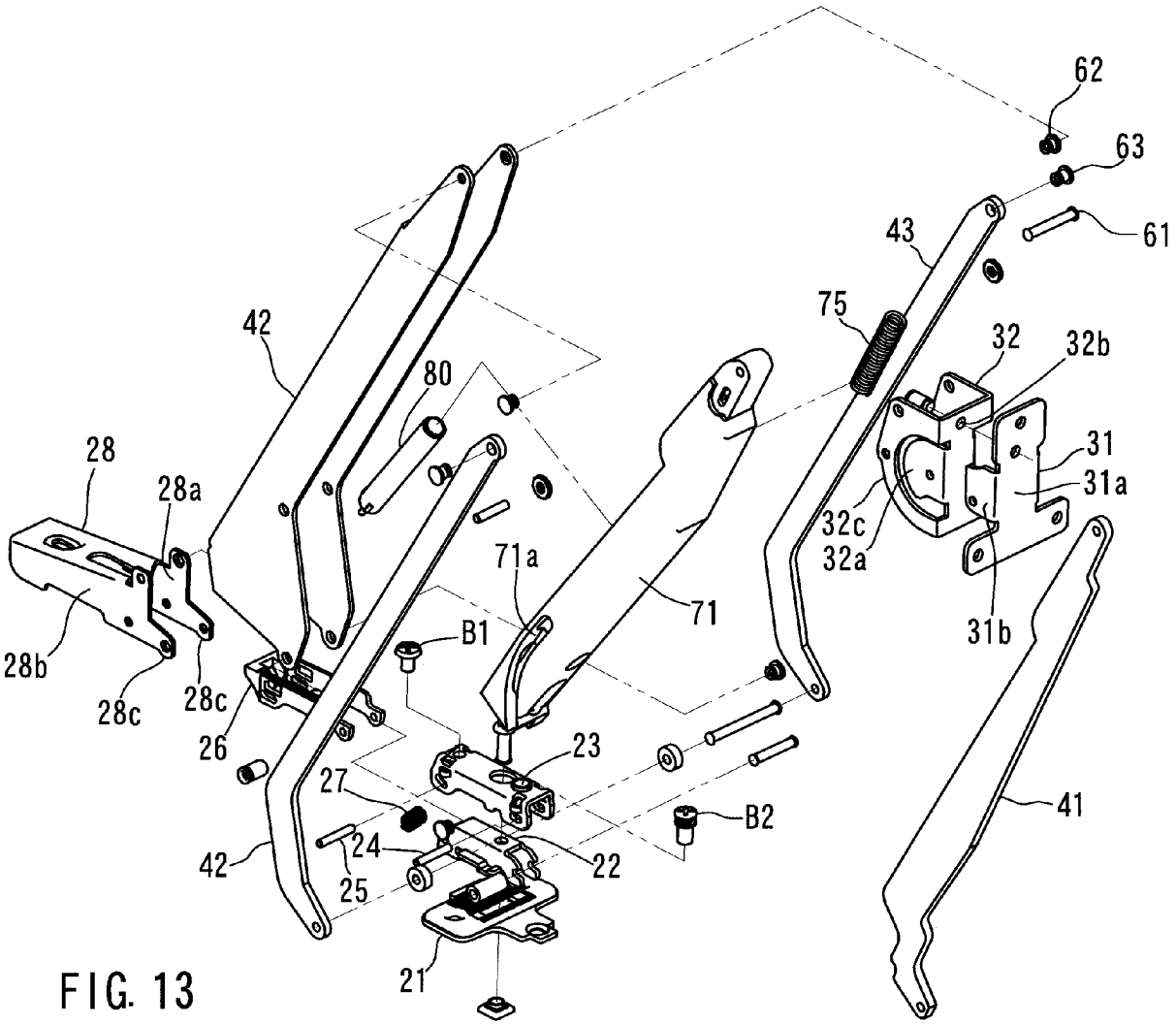
FIG. 13 is an exploded perspective view of the hinge apparatus.
Figure 14:
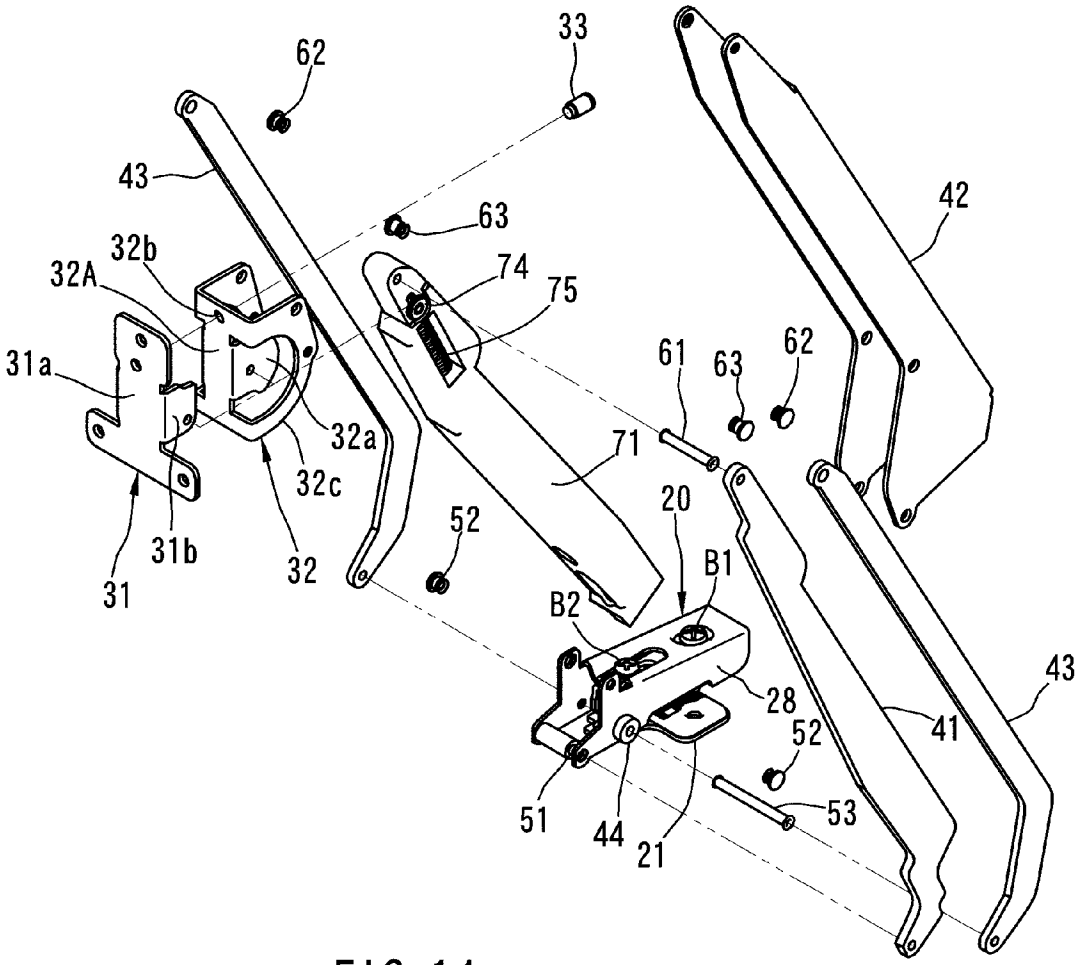
FIG. 14 is an exploded perspective view of the hinge apparatus with a first attachment member shown in an assembled condition.
Figure 15:
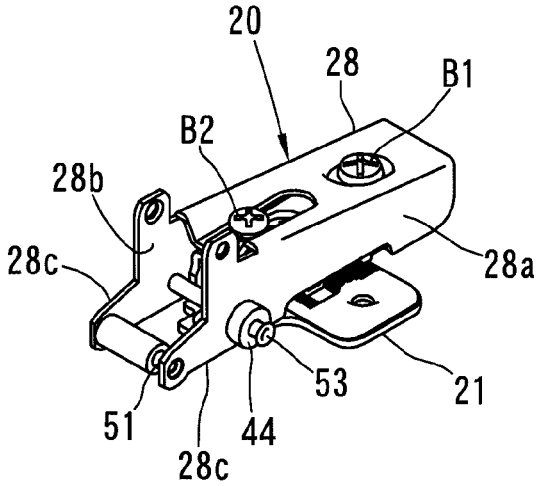
FIG. 15 is a perspective view of the first attachment member of the hinge apparatus.
Figure 16:
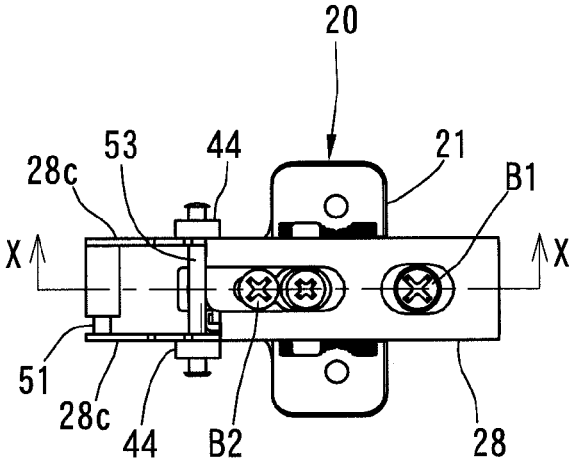
FIG. 16 is a plan view of the first attachment member.
Figure 21:
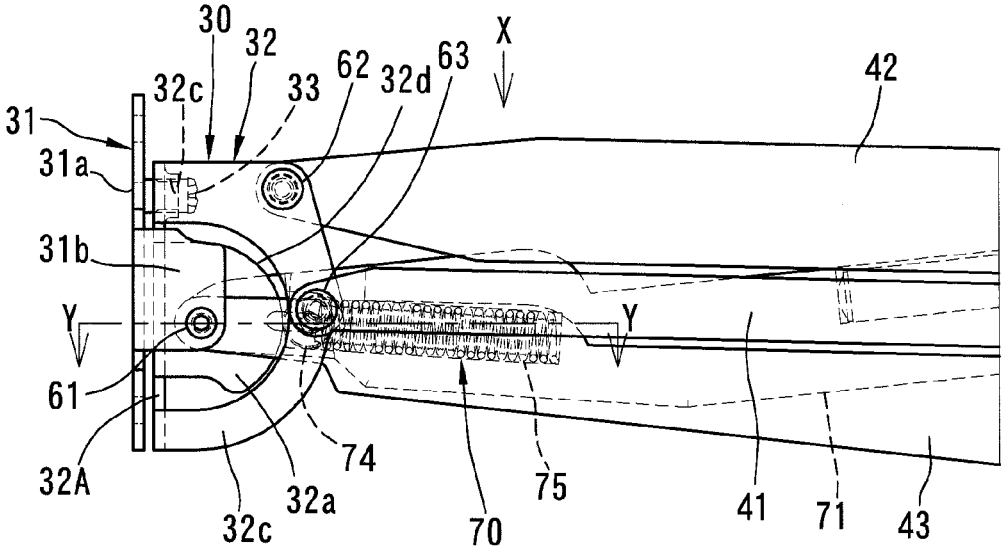
FIG. 21 is a plan view showing the second attachment member of the hinge apparatus and a vicinity of the second attachment member.
Figure 22:
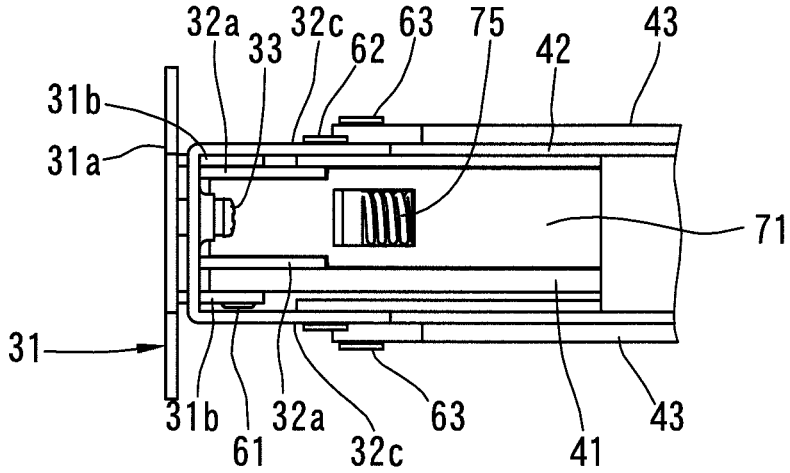
FIG. 22 is a view on arrow X of FIG. 21.
Figure 23:
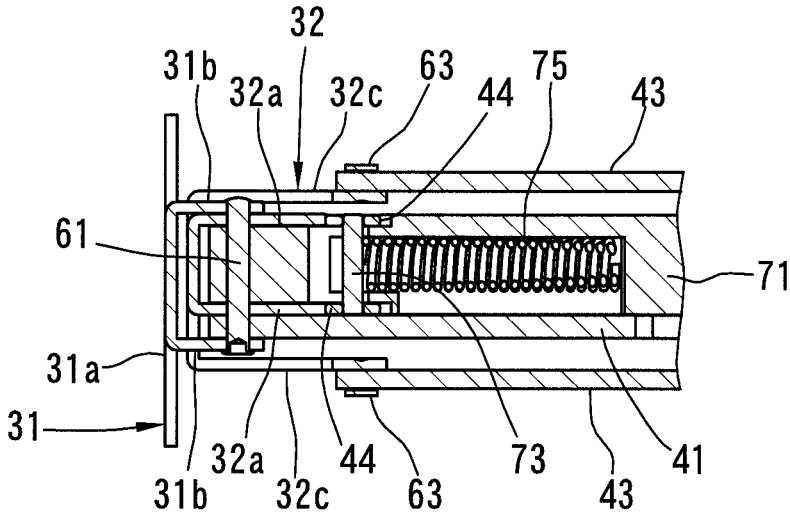
FIG. 23 is a cross-sectional view along line Y-Y of FIG. 21.

As shown in FIGS. 13, 14 and 21, a screw hole 32*b* is formed in the one end portion of the flat plate portion 32A in the left-right direction. An adjustment screw 33 is threadedly engaged with the screw hole 32*b* and extends through the screw hole 32*b*. One end portion of the adjustment screw 33 passed through the screw hole 32*b* is connected to the base part 31 such that the adjustment screw 33 is rotatable but non-movable in a longitudinal direction (front-rear direction) of the adjustment screw 33. Accordingly, when the adjustment screw 33 is rotated in one and the other directions, the support part 32 is rotated with respect to the base part 31 about the rotation shaft 61 in the horizontal direction. By this rotation operation, an attitude of the support part 32 with respect to the base part 31 can be changed (see FIGS. 19 and 20). As will be described later, it is an attitude of the base part 31 with respect to the support part 32 that is actually changed. As is clear from the foregoing, the adjustment screw 33 and the screw hole 32*b* constitute a door side adjustment mechanism. It is preferable that a nut (not shown) is threadedly engaged in the other end portion of the adjustment screw 33 and the nut is tightened to fix the adjustment screw 33 to the base part 31 after the attitude of the support part 32 has been adjusted, and thereby the support part 32 is fixed to the base part 31.

A pair of circular arc portions 32*c*, 32*c* having a generally half-circular configuration are formed in the flat plate portion 32A. The pair of circular arc portions 32*c*, 32*c* are arranged to be spaced from each other in the top-bottom direction and opposed to each other. Moreover, the upper circular arc portion 32*c* is located above the upper cam plate portion 32*a* by a predetermined distance and the lower circular arc portion 32*c* is located below the lower cam plate portion 32*a* by a predetermined distance. As is clear from FIGS. 19 and 20, an inner diameter of the circular arc portion 32*c* is greater than an outer diameter of the cam plate portion 32*a*.

As shown particularly in FIGS. 1 to 9, the support part 32 is connected to the connecting member 28 via the first link 42, the second link 43 and the third link 41 such that the support part 32 can be rotated between a closed position shown in FIGS. 1 and 2 and an open position shown in FIGS. 5 and 6.

Figure 7:
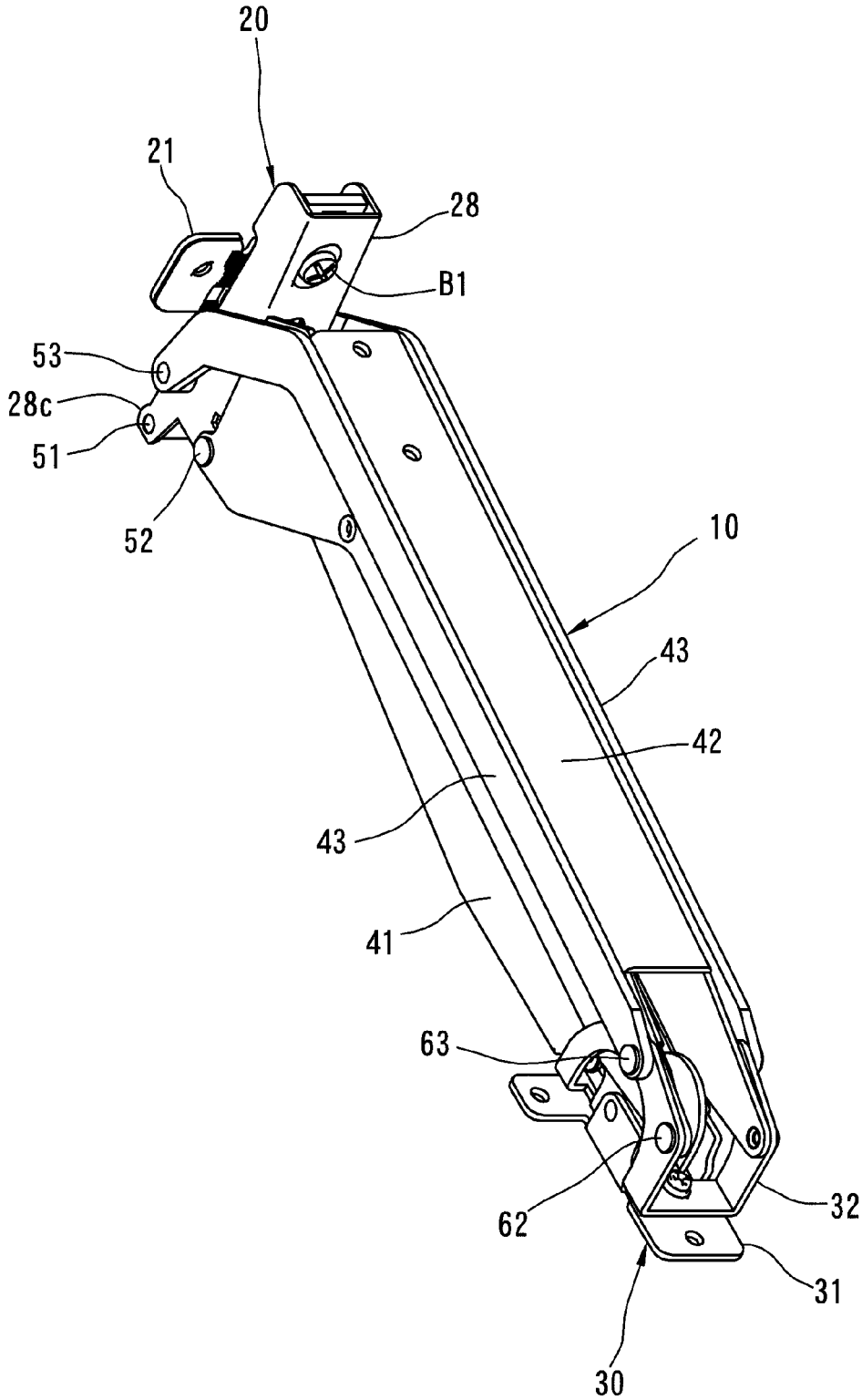
FIG. 7 is a perspective view of a hinge apparatus used in the first embodiment when the door is in the closed position.
Figure 8:
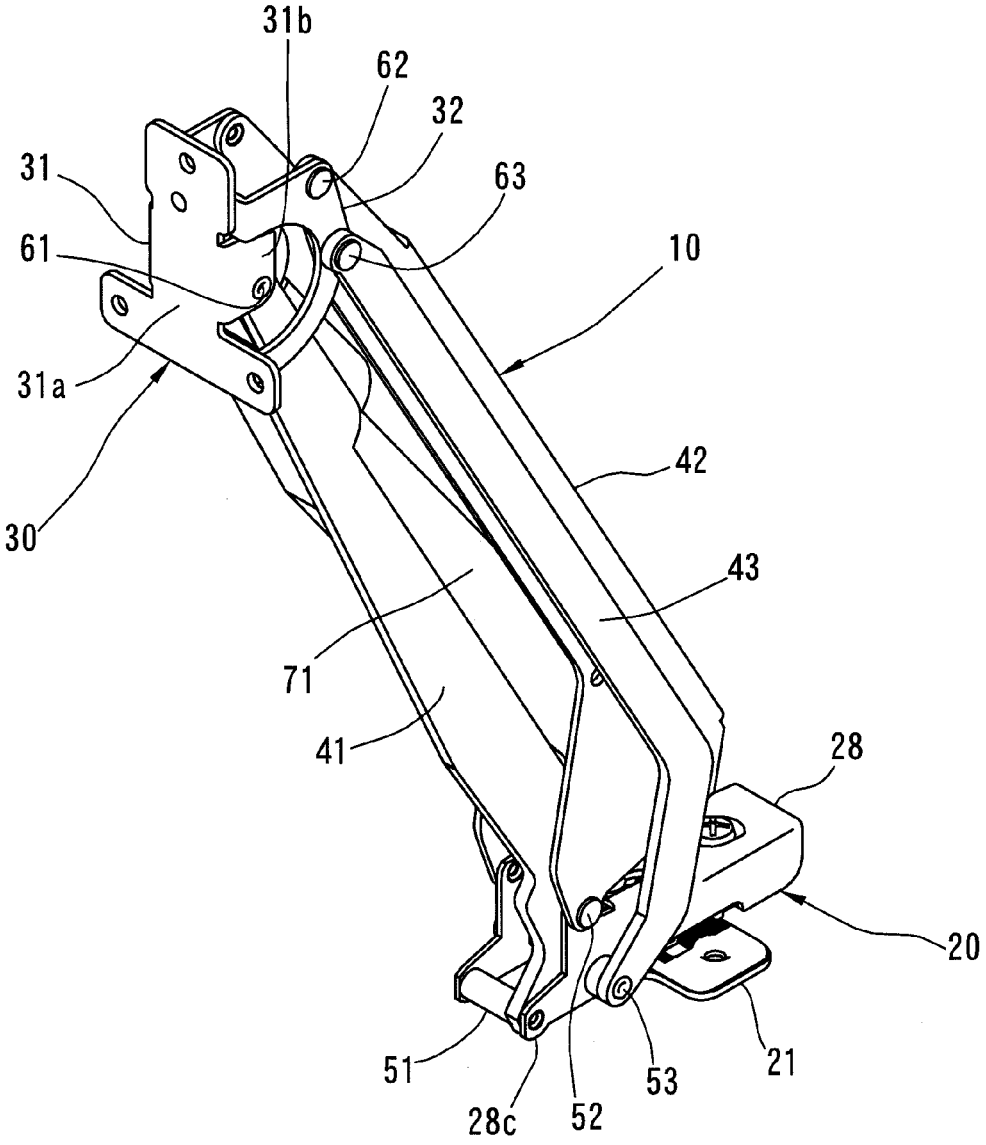
FIG. 8 is a perspective view of the hinge apparatus seen from a different direction from FIG. 7.
Figure 9:
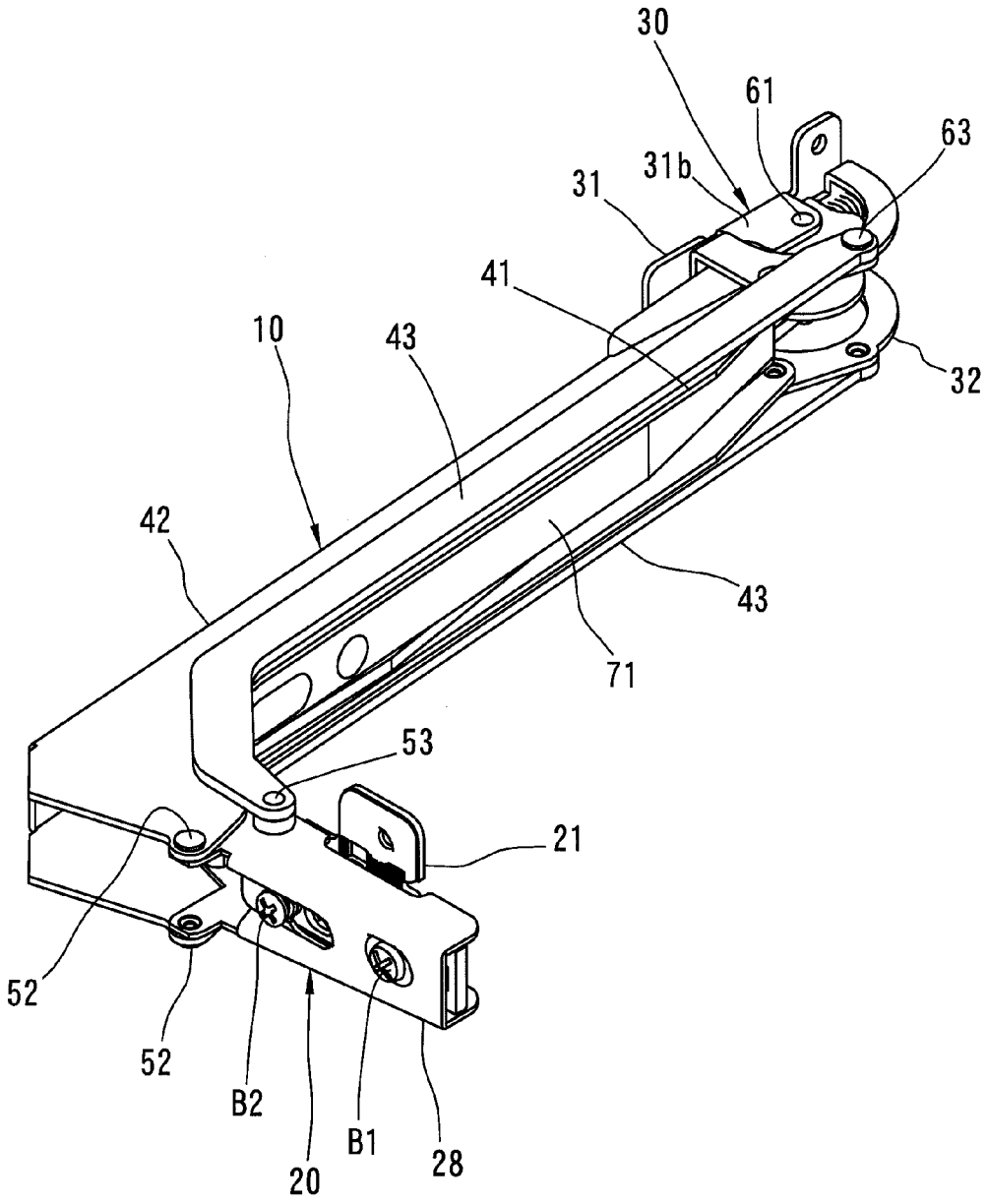
FIG. 9 is a perspective view of the hinge apparatus when the door is in the open position.
Figure 10:
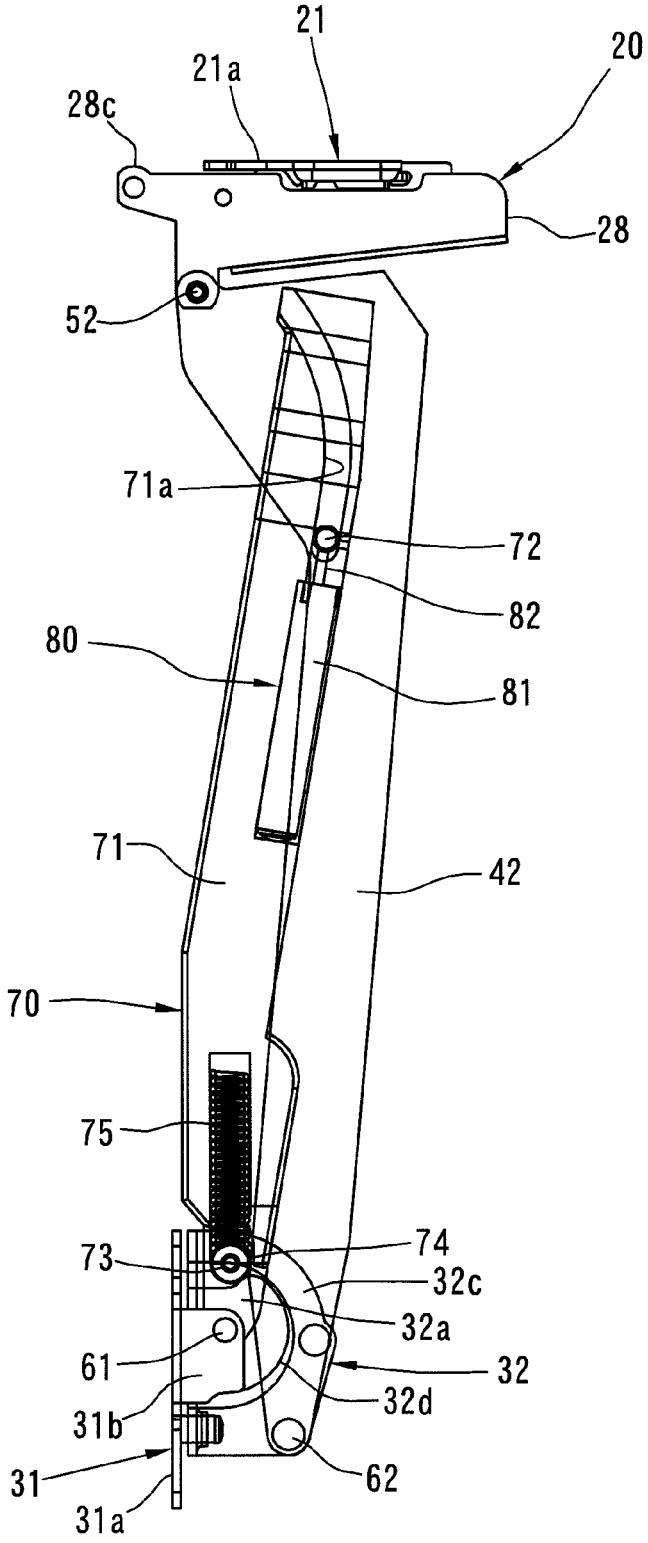
FIG. 10 is a perspective plan view of rotationally biasing means and a damper apparatus of the hinge apparatus when the door is in the closed position.
Figure 11:
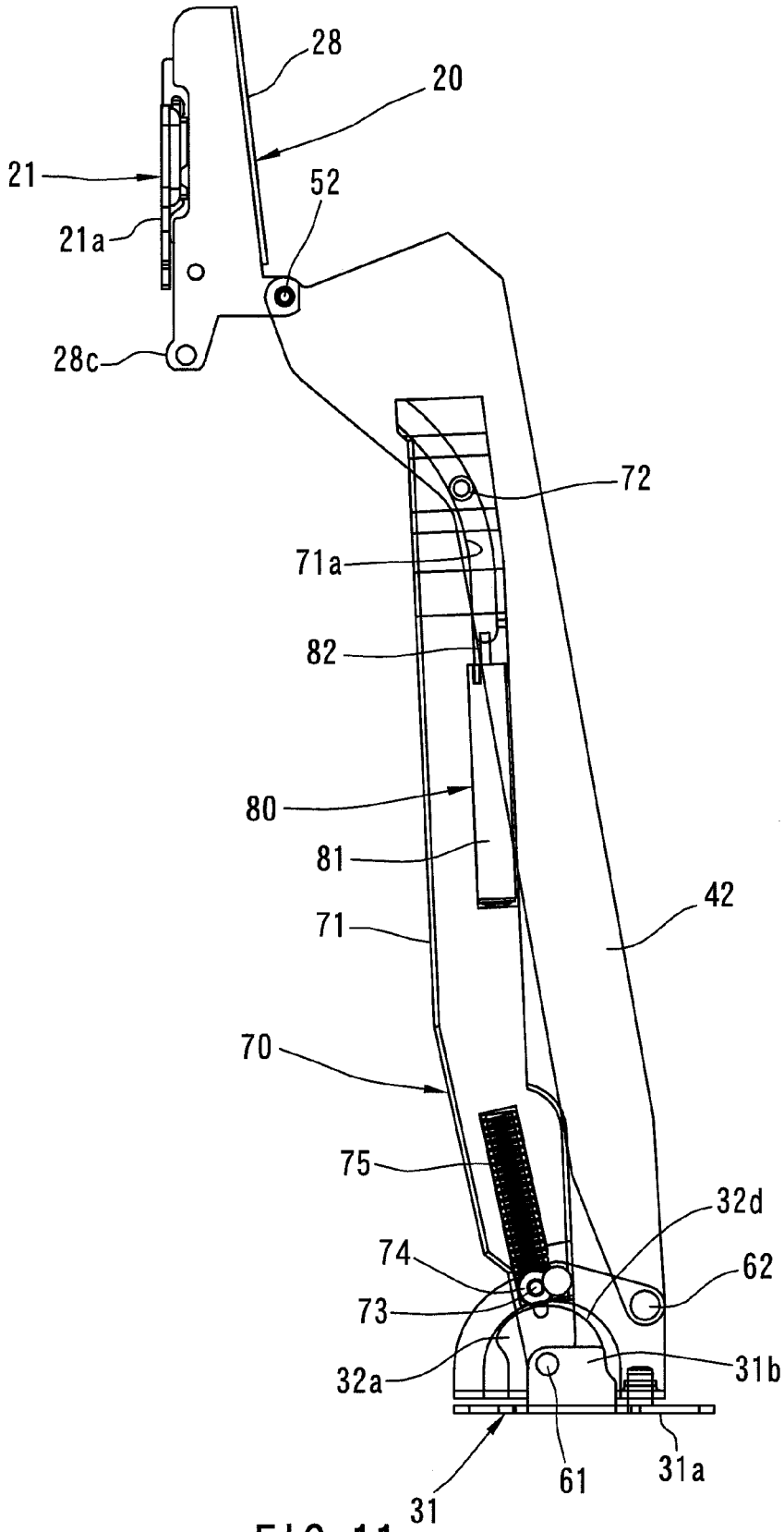
FIG. 11 is a perspective plan view of the rotationally biasing means and the damper apparatus of the hinge apparatus when the door is in the intermediate position.
Figure 12:
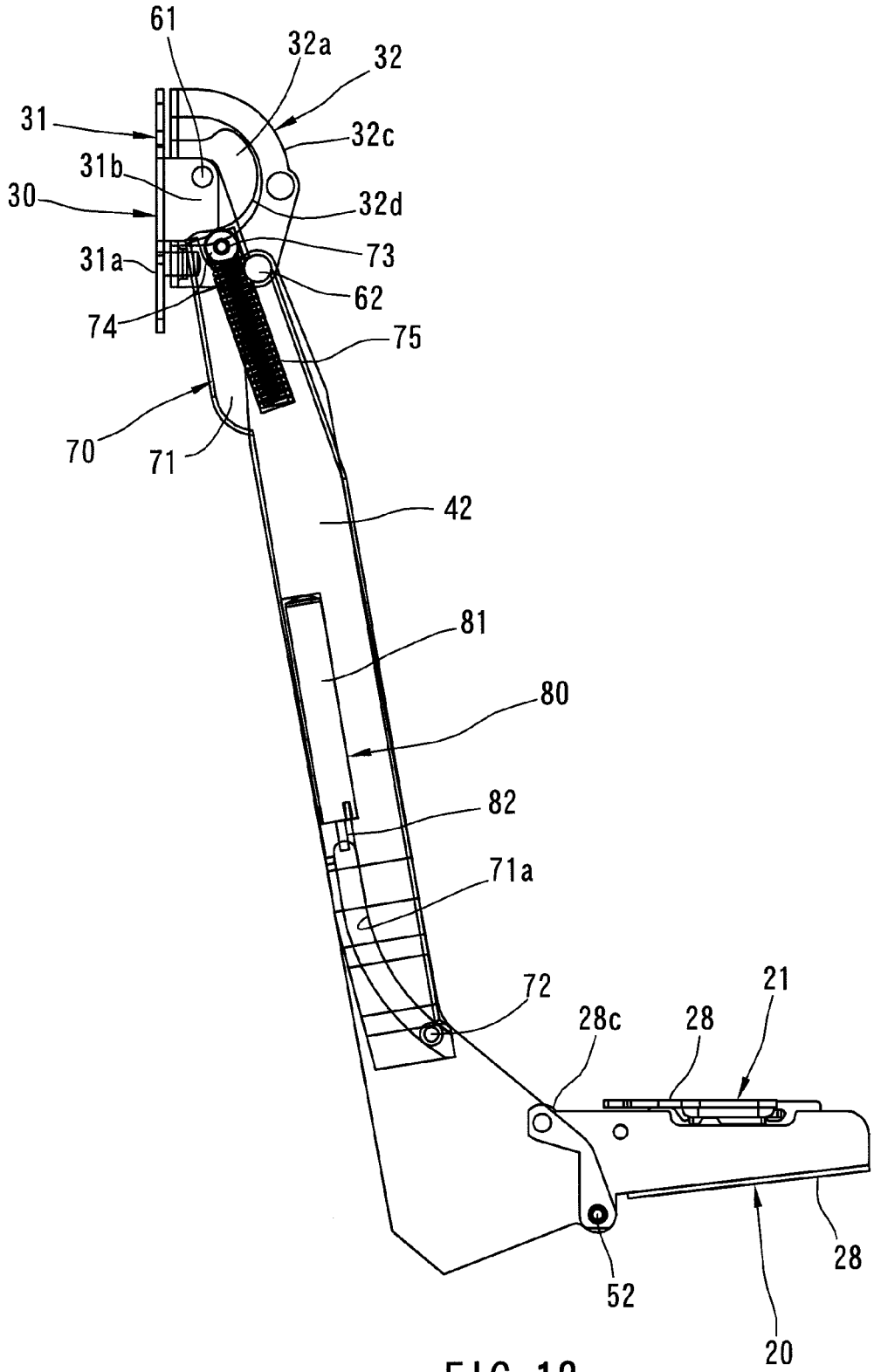
FIG. 12 is a perspective plan view of the rotationally biasing means and the damper apparatus of the hinge apparatus when the door is in the open position.

To be more specific, the first link (second link) 42 is, as particularly shown in FIGS. 7 and 14, formed to have a U-shaped cross-sectional configuration. Basal end portions (lower end portions in FIG. 8) of opposite side plates of the first link 42 are opposed to front end portions of the opposite side plate portions 28*a*, 28*b* of the connecting member 28 in the top-bottom direction (left-right direction in FIG. 8). Inner surfaces of the basal end portions of the opposite side plate portions of the first link 42 are respectively in contact with outer surfaces of the front end portions of the opposite side plate portions 28*a*, 28*b* of the connecting member 28. Moreover, basal end portions of the opposite side plate portions of the first link 42 are rotatably connected to the front end portions (left end portions in FIG. 2) of the opposite side plate portions 28*a*, 28*b* of the connecting member 28 via a rotation shaft (second rotation shaft) 52 extending in the top-bottom direction.

The second link 43 has a flat plate configuration and two second links 43 are used. The two second links 43, 43 are respectively disposed outside (upper side and lower side) of the basal end portions of the opposite side plate portions of the first link 42. Basal end portions of the second links 43, 43 are rotatably connected to the front end portions of the side plate portions 28*a*, 28*a* of the connecting member 28 via a rotation shaft 53 extending in the top-bottom direction. Moreover, the basal end portions of the second links 43, 43 are respectively in contact with outer surfaces of the side plate portions 28*a*, 28*b* of the connecting member 28 via spacers 44, 44 having a circular plate configuration. A thickness of the spacer 44 is designed to be equal to or slightly greater than a thickness of the side plate portion of the first link 42. Therefore, when the first and the second links 42, 43 are respectively rotated about the shafts 52, 53, the first and the second links 42, 43 are not abutted with each other.

The third link (first link) 41 has a flat plate configuration and only one third link 41 is used. Two third links 41 may be used. A basal end portion of the third link 41 is positioned so as to be in contact with an inner surface of the front end portion of one of the side plate portions 28*a* of the connecting member 28. The third link 41 may be disposed so as to be in contact with an inner surface of the other of the side plate portions 28*b*. When two third links 41 are used, the third links 41 are disposed so as to be respectively in contact with the inner surfaces of the opposite side plate portions 28*a*, 28*b* of the connecting member 28. The basal end portion of the third link 41 is rotatably connected to one of the side plate portions 28*a* of the connecting member 28 via a rotation shaft (first rotation shaft) 51 extending in the top-bottom direction. The third link 41 is spaced from the upper side plate portion of the first link 42 in a downward direction by a distance corresponding to a thickness of the upper side plate portion 28*a* of the connecting member 28. Therefore, when the first and the third links 42, 41 are respectively rotated about the shafts 52, 51, the first and the third links 42, 41 do not interfere with each other. The second and the third links 43, 41 do not interfere, either.

Distal end portions of the opposite side plate portions of the first link 42 are inserted between the pair of circular arc portions 32*c*, 32*c* of the support part 32 such that the distal end portions are respectively in contact with inner surfaces of the pair of circular arc portions 32*c*, 32*c* (opposing surfaces of the circular arc portions 32*c*, 32*c*). Distal end portions of the opposite side plate portions of the first link 42 are rotatably connected to the pair of circular arc portions 32*c*, 32*c* via a rotation shaft 62 extending in the top-bottom direction.

Distal end portions of the pair of second links 43, 43 are disposed so as to be respectively in contact with outer surfaces of the pair of circular arc portions 32*c*, 32*c* of the support part 32 and are rotatably connected to the pair of circular arc portions 32*c*, 32*c* via a shaft 63 extending in the top-bottom direction.

A distal end portion of the third link 41 is inserted between the lower protruded plate portion 31*b* of the base part 31 and the lower cam plate portion 32*a* of the support part 32 and are rotatably connected to the protruded plate portion 31*b* and the cam plate portion 32*a* via the rotation shaft 61.

The rotation shafts 51, 52, 53 and the rotation shafts 61, 62, 63 all extend in the top-bottom direction and are parallel to each other. Moreover, the rotation shafts 51, 52, 53 and the rotation shafts 61, 62, 63 are arranged such that axes (rotation centers) of the rotation shafts 51, 52, 53 respectively represent apexes of a triangle and axes (rotation centers) of the rotation shafts 61, 62, 63 respectively represent apexes of a triangle when viewed from longitudinal directions thereof (top-bottom direction). Furthermore, the rotation shafts 51, 52, 53 and the rotation shafts 61, 62, 63 are arranged to satisfy the following relationship. That is, a center distance between the shafts 51, 61, a center distance between the shafts 52, 62 and a center distance between the shafts 53, 63 are set to be equal to each other. Moreover, a center distance between the shafts 51, 52 and a center distance between the shafts 61, 62 are set to be equal to each other, a center distance between the shafts 52, 53 and a center distance between the shafts 62, 63 are set to be equal to each other and a center distance between the shafts 53, 51 and a center distance between the shafts 63, 61 are set to be equal to each other. As a result, a parallel link mechanism is constituted by the connecting member 28 (first attachment member 20), the support part 32 (second attachment member 30), the first link 42, the second link 43 and the third link 41. Therefore, in the container apparatus 1, the support part 32 is translated with respect to the connecting member 28. In other words, the support part 32 is rotated about the connecting member 28 being maintained in a constant attitude with respect to the connecting member 28. Therefore, the door 3 is translated with respect to the housing 2 as well.

The first link 42 of the hinge apparatus 10 disposed on an upper side of the housing 2 and the first link 42 of the hinge apparatus 10 disposed on a lower side of the housing 2 are connected to each other at corresponding points by a connecting plate 5 such that the first links 42 rotate in synchronization with each other. By this arrangement, the two hinge apparatus 10, 10 are reinforced by each other.

The door 3 is translated between the closed position shown in FIGS. 1 and 2 and the open position shown in FIGS. 5 and 6. When the door 3 is in the closed position, the rear surface 3*a* of the door 3 is abutted against the front surface 2*a* of the housing 2, closing the entirety of the opening of the housing 2. On the other hand, when the door 3 is in the open position, the entirety of the door 3 is positioned to the left (upper side in FIG. 6) of the opening of the housing 2, opening the entirety of the opening. As is clear from FIG. 6, the open position of the door 3 is defined by the abutment of the first link 42 against the shaft 53. The open position of the door 3 can also be defined by the abutment of either one of the first to the third links 41, 42, 43 against either one of the shafts 51, 52, 53 that is not the shaft rotatably supporting the link.

The door 3 is designed such that when the door 3 is in the closed position, the rear surface 3*a* of the door 3 is in contact with the entire front surface 2*a* of the housing 2. However, only one end portion or the other end portion of the rear surface 3*a* in the left-right direction may be in contact with the front surface 2*a* of the housing 2, with the other end portion or the one end portion spaced from the front surface 2*a* of the housing 2 in the front-rear direction. In such cases, the door 3 can be rotated in the horizontal direction as appropriate to bring the rear surface 3*a* of the door 3 into contact with the entire front surface 2*a* of the housing 2 by rotating the connecting member 28 in the horizontal direction by the housing side adjustment mechanism, by rotating the base part 31 in the horizontal direction with respect to the support part 32 by the door side adjustment mechanism or by rotating both of the connecting member 28 and the base part 31 in the horizontal direction by both of the adjustment mechanisms. Especially when the adjustment is made by the door side adjustment mechanism, even if various articles are contained in the housing 2, an attitude of the door 3 can be adjusted without taking out the articles from the housing 2. When the connecting member 28 is rotated in the horizontal direction by the housing side adjustment mechanism, the front end portion of the connecting member 28 is moved in the left-right direction by a distance according to the amount of rotation. By subsequently adjusting the attitude of the door 3 by the door side adjustment mechanism, the attitude of the door 3 can be adjusted, and moreover, the door 3 in the left-right direction can also be position-adjusted.

As shown in FIG. 2, a protruded portion 28*c* protruded forward is formed in the front end portion of the connecting member 28. The protruded portion 28*c* is protruded further forward than the front surface 2*a* of the housing 2. The rotation shaft (first rotation shaft) 51 is disposed in a distal end portion of the protruded portion 28*c* protruded further forward than the front surface 2*a*. Accordingly, the rotation shaft 51 is disposed further in front than the front surface 2*a*. As a result, when the door 3 is in the closed position, the rotation shaft 51 is positioned further in front than the rear surface 3*a* of the door 3 and the second attachment surface 31*a* of the second attachment member 30. Particularly in this embodiment, since the entirety of the first attachment surface 21*a* is disposed further behind than the front surface 2*a*, the rotation shaft 51 is disposed on an opposite side from the entirety of the first attachment surface 21*a* with respect to the second attachment surface 31*a*. However, in a case where a portion of the first attachment surface 21*a* in a front side is located further in front than the front surface 2*a* (second attachment surface 31*a*), the rotation shaft 51 is disposed on an opposite side from a portion of the first attachment surface 21*a* located further behind than the front surface 2*a* that accounts for a majority of the first attachment surface 21*a* with respect to the second attachment surface 31*a*. Since the rotation shaft 51 and the protruded portion 28*c* are protruded further forward than the front surface 2*a*, it is required to prevent the rotation shaft 51 and the protruded portion 28*c* from being abutted against the rear surface 3*a* of the door 3 when the door 3 is rotated to the closed position. To meet this requirement, a recess 3*b* that protrusibly and retractably receives the protruded portion 28*c* and the rotation shaft 51 is formed in the rear surface 3*a* of the door 3.

As is clear from FIG. 2, when the door 3 is in the closed position, the rotation shafts 51, 52, 53 and the rotation shafts 61, 62, 63 are positioned on the same side with respect to the inner side surface 2*d*, i.e., in a space from the inner side surface 2*d* to the other side portion side. Moreover, the rotation shafts 61, 62, 63 are more spaced from the inner side surface 2*d* than the rotation shafts 51, 52, 53 in a direction from the inner side surface 2*d* to the other side portion.

Instead of the rotation shaft 51, the rotation shaft 52 or the rotation shaft 53 may be disposed further in front than the front surface 2*a*. In this case, the rotation shaft 52 or the rotation shaft 53 disposed further in front than the front surface 2*a* becomes the first rotation shaft and one of the remaining rotation shafts 51, 53 (52) becomes the second rotation shaft. To describe the relationship between the three rotation shafts 51, 52, 53 more in detail, of the three rotation shafts 51, 52, 53, any one of the rotation shafts 51 (52, 53) may be disposed further outside (opposite side) than the front surface 2*a* with the remaining two rotation shafts 52, 53 (53, 51; 51, 52) disposed further inside (one side) than the front surface 2*a*. Alternatively, any two of the rotation shafts 51, 52 (52, 53; 53, 51) may be disposed further outside than the front surface 2*a* with the remaining one rotation shaft 53 (51; 52) disposed further inside than the front surface 2*a*. Alternatively, all of the rotation shafts 51, 52, 53 may be disposed further outside than the front surface. The same applies to second to fifth embodiments to be described later.

In addition to the components mentioned above, the container apparatus 1 further includes rotationally biasing means 70 and a damper unit 80.

The rotationally biasing means 70 moves the door 3 to the closed position and maintains the door 3 at the closed position by rotationally biasing the first link 41 toward a closed position when the door 3 is in a position between the closed position and a position (referred to as "biasing start position" hereinafter) spaced from the closed position toward the open position by a predetermined distance (for example, a distance generally corresponding to 20 degrees in rotation angle of the first link 42). On the other hand, the damper unit 80 restrains a speed of movement of the door 3 by the rotationally biasing means 70 toward the closed direction to a low speed, thereby softening an impact of the door 3 on the housing 2 at the time of abutment.

To explain about the rotationally biasing means 70, as shown in FIGS. 10 to 12 and FIGS. 21 to 23, the rotationally biasing means 70 includes an arm 71. The arm 71 is disposed between the lower side plate portion of the first link 42 and the first link 43 in the top-bottom direction and is parallel to the first link 42 and the first link 43. A distal end portion (end portion on the second attachment member 30 side) of the arm 71 is inserted between the cam plate portions 32*a*, 32*a* of the support part 32 and rotatably connected to the cam plate portions 32*a*, 32*a* via the rotation shaft 61. On the other hand, a guide groove 71*a* is formed in a basal end portion (end portion nearer to a basal end of the first link 42) of the arm 71. A shaft 72 fixed to the first link 42 with an axis of the shaft 72 oriented in the top-bottom direction is inserted in the guide groove 71*a* such that the shaft 72 is movable in a longitudinal direction of the guide groove 71*a*. Therefore, when the first link 42 is rotated accompanying the movement of the door 3, the arm 71 is rotated about the shaft 61 following the rotation of the first link 42. In other words, when the arm 71 is rotated, the first link 42 is rotated following the rotation of the arm 71, and the door 3 is rotated. Moreover, when the arm 71 is rotated, the shaft 72 is moved inside the guide groove 71*a* in the longitudinal direction of the guide groove 71*a* accompanying the rotation of the arm 71. At this time, when the first link 42 is rotated such that the door 3 is moved toward the closed position, the shaft 72 is moved inside the guide groove 71*a* in a direction from the basal end of the first link 42 to a distal end of the first link 42. When the first link 42 is rotated such that the door 3 is moved toward the open position, the shaft 72 is moved inside the guide groove 71*a* in a direction from the distal end of the first link 42 to the basal end of the first link 42.

A cam surface (cam portion) 32*d* is formed in an outer peripheral surface of each of the pair of cam plate portions 32*a* of the support part 32. On the other hand, a roller (movable member) 73 with axis thereof oriented in the top-bottom direction is disposed in the distal end portion of the arm 71 such that the roller 73 is rotatable via a support shaft 74 and movable in a direction (radial direction of a circle centered about the shaft 61) towards and away from the cam surface 32*d*. A biasing member 75 such as a coil spring is disposed in an inside of the arm 71 with a longitudinal direction of the biasing member 75 oriented in a longitudinal direction of the arm 71. The biasing member 75 biases the roller 73 via the support shaft 74 and presses the roller 73 against the can surface 32*d*. Biasing force of the biasing member 75 is converted into a rotationally biasing force that rotates the arm 71 by the cam surface 32*d* and the roller 73 pressed against each other. And the rotation of the arm 71 causes the door 3 to be rotated to be open and closed. In this case, when the door 3 is in a position between the closed position and a position spaced from the closed position toward the open position by a predetermined angle (20 degrees, for example), the door 3 is rotated from the open position side to the closed position and maintained at the closed position by the rotationally biasing means 70. When the door 3 is between a predetermined intermediate position, the intermediate position being between the closed position and the open position, and positions spaced from the intermediate position by a predetermined angle (20 degrees, for example) respectively toward the closed position and the open position, the door 3 is rotated to the intermediate position and maintained at the intermediate position by the rotationally biasing means 70. When the door 3 is in a position between the open position and a position spaced from the open position toward the closed position by a predetermined angle (20 degrees, for example), the door 3 is rotated from the closed position side to the open position and maintained at the open position by the rotationally biasing means 70. When the door 3 is in a position outside of an area mentioned above, the biasing force of the biasing member 75 is not converted into the rotational biasing force by the cam surface 32*d* and the roller 73, and the door 3 can be stopped at any position.

When the rotational biasing means 70 is constructed as mentioned above, the rotational biasing means 70 can be downsized and therefore the hinge apparatus 10 can be downsized since the arm 71 is disposed parallel to the first link 42 and the biasing member 75 is disposed inside the arm 71 with the longitudinal direction of the biasing member 75 oriented to the longitudinal direction of the arm 71.

Instead of the rotational biasing means 70 having the above-mentioned construction, other rotational biasing means having different constructions may be used. For example, an abutment member, may be disposed in the arm 71 such that the abutment member is movable but non-rotatable and the abutment member may be pressed against the cam surface 32*d*. Alternatively, the first link 42 may be rotationally biased directly by a torsion coil spring or the like.

The damper unit 80 is built in the arm 71. The damper unit 80 includes a body 81 disposed in the arm 71 with a longitudinal direction of the body 81 oriented to the longitudinal direction of the arm 71 and a movable rod 82 disposed in the body 81 such that the movable rod 82 is movable in a longitudinal direction of the body 81. The body 81 is fixedly disposed in the arm 71. On the other hand, the movable rod 82 is disposed in the body 81 such that the movable rod 82 can be moved in a direction in which the movable rod 82 is protruded from and retracted into the body 81. The movable rod 82 can be moved at a high speed in a direction in which the movable rod 82 is protruded from the body 81. However, in a direction in which the movable rod 82 is retracted into the body 81, the movable rod 82 is prohibited from being moved at a high speed by a damper unit (not shown) built in the body 81, being allowed to be moved only at a low speed. Moreover, the movable rod 82 is biased in a direction to be protruded from the body 81 by biasing means (not shown) such as a coil spring built in the body 81 and positioned at a predetermined initial position when the movable rod 82 is in a natural state in which no external force works thereon.

In a case where the door 3 is moved from the open position side to the closed position side, when the door 3 reaches the position located the predetermined angle (20 degrees, for example) before the closed position, the door 3 is rotated toward the closed position by the rotationally biasing means 70. When the door 3 is rotated toward the closed position by the rotationally biasing means 70 through a predetermined angle, 10 degrees, for example, the shaft 72 is abutted against a distal end surface of the movable rod 82. Therefore, a speed of movement of the shaft 72 toward the distal end of the arm 71 is restrained at a low speed. As a result, a speed of rotation of the arm 71 and the first link 42 toward a closed position is restrained at a low speed, thereby the speed of movement of the door 3 toward the closed position being restrained at a low speed. Therefore, the door 3 is abutted against the front surface 2*a* of the housing 2 at a low speed, and thereby the impact at the time of the abutment can be softened.

In the container apparatus 1 having the above mentioned construction, let us assume that the door 3 is in the closed position. When the door 3 reaches the intermediate position shown in FIGS. 3 and 4 and the first to the third links 42, 43, 41 are rotated about 90 degrees accompanying the movement of the door 3, the door 3 is positioned most forward with respect to the front surface 2*a* of the housing 2. A spaced distance of the door 3 is the same as a length of the first to the third links 42, 43, 41 (center distance). The spaced distance of the door 3 is generally a half of a length of the door 3 in the left-right direction. Therefore, in the container apparatus 1, compared with a conventional container apparatus in which one side portion of the door 3 in the left-right direction is rotated 90 degrees forward about the other side portion of the door 3, a space required in front of the housing 2 can be reduced. In other words, even when the space in front of the housing 2 is narrow, the door 3 can be sufficiently opened.

As shown in FIG. 6, when the first link 42 is viewed from the axial direction (top-bottom direction) of the shafts 52, 62 that are rotation centers of the first link 42, the first link 42 is bent at an intermediate portion that is nearer to a basal end portion than a central portion (central portion between the shafts 52, 62) of the first link 42. The bent portion of the first link 42 is positioned in front with respect to a straight line connecting the shafts 52, 62 when the door 3 is moved to the open position. The second and the third links 43, 41 are bent in a similar manner. In a condition where the first, the second and the third links 42, 43, 41 are bent in this manner, when the door 3 is moved toward the open position, the first, the second and the third links 42, 43, 41 can be prevented from interfering an end edge of the front surface 2*a* of the housing 2. In other words, the first, the second and the third links 42, 43, 41 can be rotated further toward the open position by a degree corresponding to the amount of bending, thereby allowing the door 3 to be opened wider. In this embodiment, since the front surface portion of the housing 2 is open, the first to the third links 42, 43, 41 are bent such that bent portions of the first to the third links 42, 43, 41 are located in front with respect to the straight line connecting the centers when the door 3 is moved to the open position. In a case where a side surface portion of the housing 2 is open, the links 42, 43, 41 may be bent such that the bent portions of the links 42, 43, 41 are located to the left or to the right with respect to the straight line connecting the centers, and outside of the housing 2 when the door 3 is moved to the open position. In a case where an upper surface portion of the housing 2 is open, the links 42, 43, 41 may be bent such that the bent portions of the links 42, 43, 41 are located above the straight line connecting the centers when the door 3 is moved to the open position.

As the links to connect the connecting member 28 and the support part 32, the three links 42, 43, 41 are used and the shafts 52, 53, 51; 62, 63, 61 respectively as the rotation centers of the links 42, 43, 41 are arranged to represent apexes of triangles. In this arrangement, regardless of the position of the door 3 between the closed position and the open position, when a rotation moment centered about a line orthogonal to the door 3 acts on the door 3, the moment can be supported against with sufficient strength. To explain it more in detail, assuming that only two of the first to the third links 42, 43, 41 are used, the two links may generally overlap each other when viewed from a longitudinal direction of rotation center lines of the two links depending on the position of the door 3. In this condition, if the rotation moment as mentioned above acts on the door 3, the two links cannot exercise sufficient strength against the rotation moment. On the other hand, in the hinge apparatus 10 used in the container apparatus 1, the rotation centers of the three links 42, 43, 41 are respectively arranged to represent apexes of a triangle. Therefore, the three links 42, 43, 41 never overlap each other in a direction of the rotation center line regardless of the position of the door, with at least one link spaced from the other two links in a direction orthogonal to the rotation center line. Therefore, even if such a rotation moment acts on the door 3, the three links 42, 43, 41 can support against the rotation moment with sufficient strength.

Since the rotation shaft 51 as the rotation center of the third link (first link) 41 is disposed outside further in front than the front surface 2*a* of the housing 2, the first attachment member 20 and the first to the third links 42, 43, 41 can be disposed further to the front compared with cases in which the rotation shaft 51 is disposed inside the housing 2 at least by the spaced distance between the front surface 2*a* and the rotation shaft 51. Therefore, an utilizable inner space of the housing 2 can be widened. Moreover, since the third link 41 is disposed further in front than the front surface 2*a*, it is hardly required for an intermediate portion of the third link 41 to be bent. Even if the intermediate portion of the third link 41 is to be bent, an amount of bending can be small. Furthermore, although the first and the second links 42, 43 are located further behind than the front surface 2*a*, an amount of bending of the first and the second links 42, 43 can also be small. It is because the first and the second links 42, 43 can be disposed to the front by a distance by which the third link 41 is disposed to the front. Therefore, when the door 3 is in the closed position, an amount of entry of the bent portion to the interior of the housing 2 can be reduced. Therefore, the utilizable inner space of the housing 2 can be further widened.

Other embodiments of the present invention will now be described. In the description of the other embodiments, the same reference numerals will be used to designate the same elements as the aforementioned embodiment and the description thereof will be omitted. In the following embodiments, the rotationally biasing means 70 and the damper unit 80 are omitted.

Figure 24:
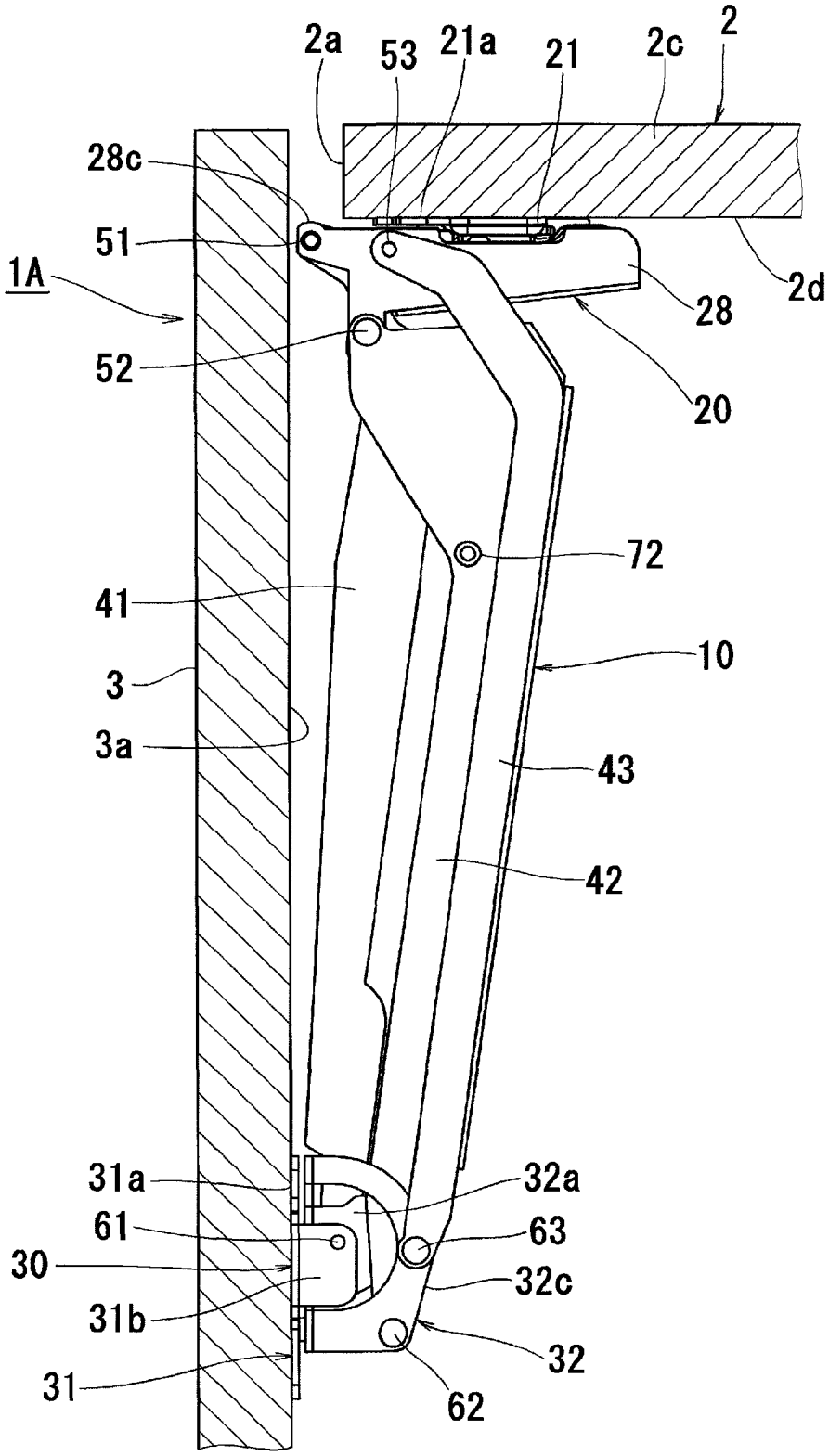
FIG. 24 is a plan cross-sectional view of a main portion of a second embodiment of the container apparatus according to the present invention when the door is in the closed position.

FIG. 24 shows the second embodiment of the container apparatus according to the present invention. In a container apparatus 1A of this embodiment, when the door 3 is in the closed position, the rear surface 3*a* of the door 3 is parallel to the front surface 2*a* of the housing 2. However, the rear surface 3*a* is not abutted against the front surface 2*a*, and is spaced forward with respect to the front surface 2*a*. A distance between the rear surface 3*a* of the door 3 and the front surface 2*a* of the housing 2 when the door 3 is closed is set to be a value equal to or slightly greater than an amount of protrusion of the protruded portion 28*c* with respect to the front surface 2*a*. Therefore, the protruded portion 28*c* and the rotation shaft 51 will not be abutted against the rear surface 3*a* of the door 3. For this reason, the recess 3*b* is not formed in the rear surface 3*a*. The closed position of the door 3 is determined by the hinge apparatus 10 as with the open position. Moreover, the open position of the door 3 is generally the same position as the open position in the first embodiment.

Figure 25:
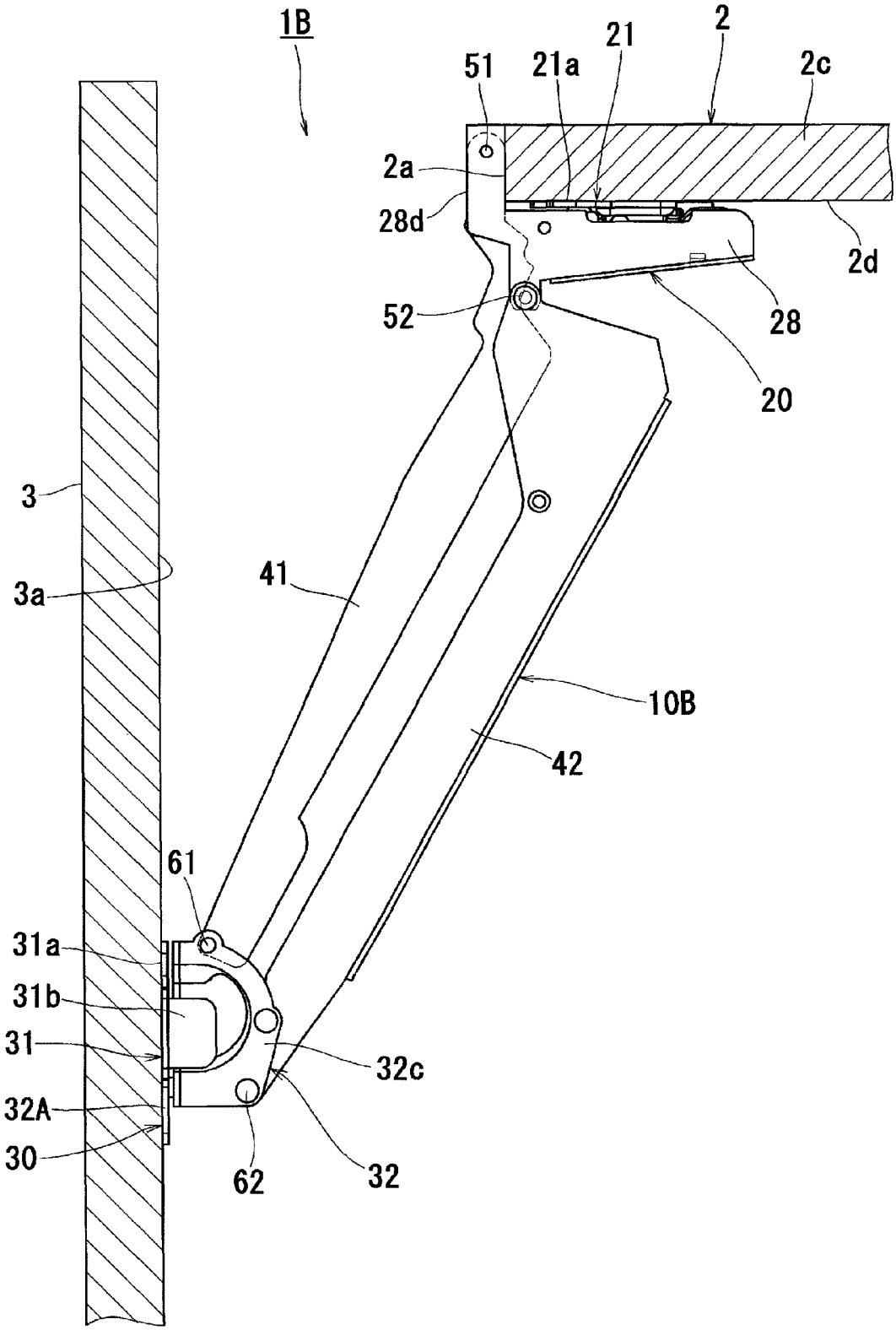
FIG. 25 is a plan cross-sectional view of a main portion of a third embodiment of the container apparatus according to the present invention when the door is in the closed position.
Figure 26:
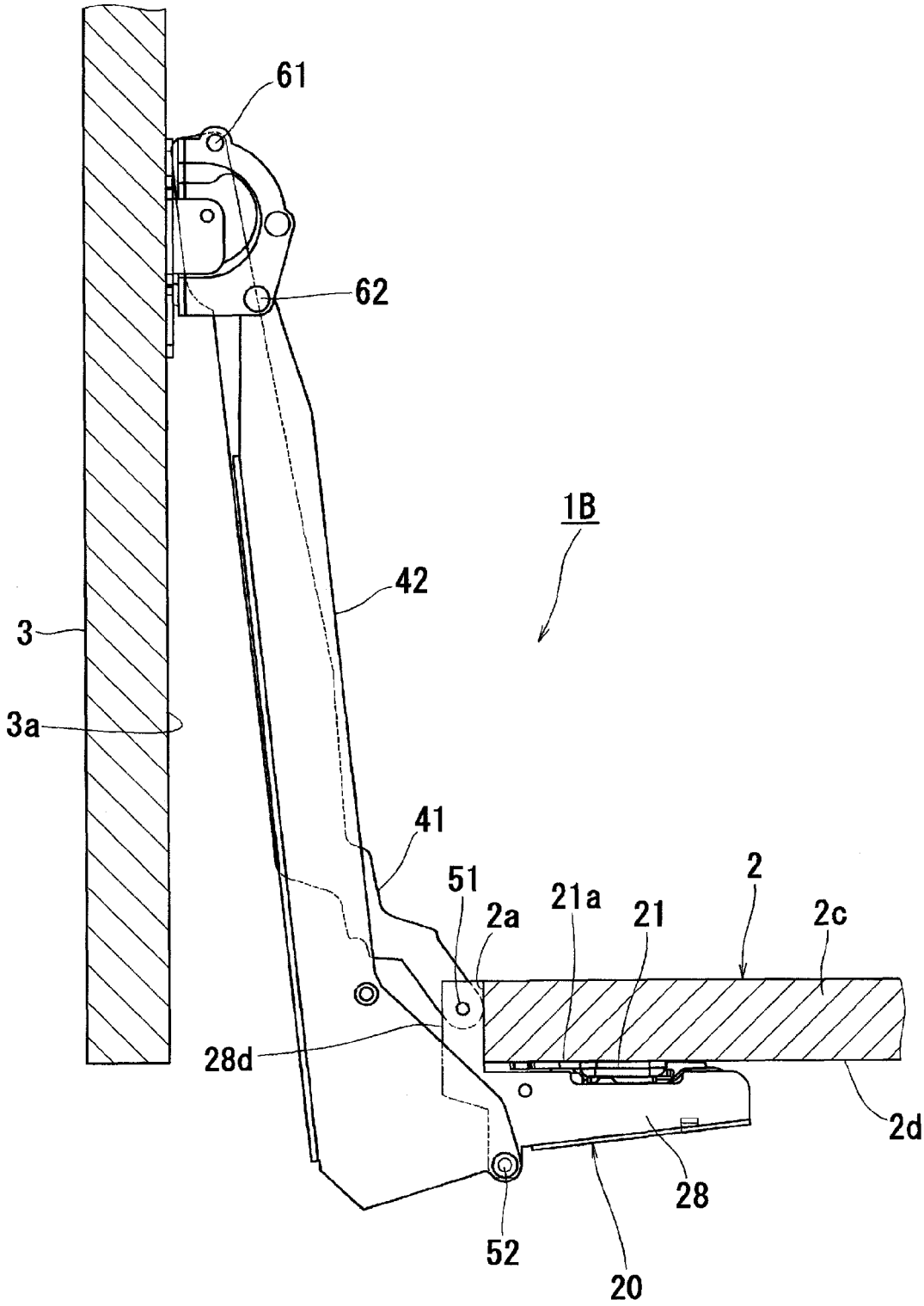
FIG. 26 is a plan cross-sectional view of the main portion of the third embodiment when the door is in the open position.

FIGS. 25 and 26 show the third embodiment of the container apparatus according to the present invention. Also in a container apparatus 1B of this embodiment, when the door 3 reaches the closed position, the door is spaced forward with respect to the front surface 2*a*. Moreover, a spaced distance between the door 3 and the front surface 2*a* is set to be greater than the spaced distance in the second embodiment mentioned above. The closed position of the door 3 is determined by a hinge apparatus 10B instead of the hinge apparatus 10. The closed position of the door 3 is determined by the hinge apparatus 10B by means similar to the means of the hinge apparatus 10 that determines the open position of the door 3.

In the hinge apparatus 10B of the container apparatus 1B, a protruded portion 28*d* instead of the protruded portion 28*c* is formed in the front end portion of the connecting member 28. The protruded portion 28*d* is protruded further forward than the front surface 2*a* and is extended outward along the front surface 2*a* up to generally the same position as an outer surface of the side wall 2*c*. The rotation shaft 51 is disposed in a distal end portion of the protruded portion 28*d*. Accordingly, the rotation shaft 51 is disposed further outside (upper side in FIG. 25) than the inner side surface 2*d* as well as being disposed further in front than the front surface 2*a*. Since the rotation shaft 51 is disposed in this manner, one end portion of the third link 41 on the rotation shaft 51 side is opposed to the front surface 2*a*, and the one end portion of the third link 41 is contacted with the front surface 2*a* when the door 3 is in the closed position. The closed position of the door 3 is determined by the contact of the one end portion with the front surface 2*a*. The rotation shaft 61 as the rotation center of the other end portion of the third link 41 is disposed in the circular arc portion 32*c* of the support part 32. Of the first and the second links 42, 43, only the first link 42 is used in this embodiment. Alternatively, the first link 42 may be omitted and only the second link 43 may be used. This also applies to other embodiments mentioned below.

In the container apparatus 1B having the above mentioned construction, since the rotation shaft 51 of the third link (first link) 41 is disposed further in front than the front surface 2*a*, the utilizable inner space of the housing 2 can be widened as with the first embodiment. Moreover, since the rotation shaft 51 is disposed further outside than the inner side surface 2*d*, a distance between the rotation shafts 51, 52 can be sufficiently great even when the rotation shaft 52 of the first link 42 is brought closer to the front surface 2*a*. In other words, if the distance between the rotation shafts 51, 52 is set to be constant, the rotation shaft 52 can be disposed nearer the front surface 2*a* by a distance by which the rotation shaft 51 is disposed further outside than the inner side surface 2*d*. Therefore, the utilizable inner space of the housing 2 can be further widened.

Figure 27:
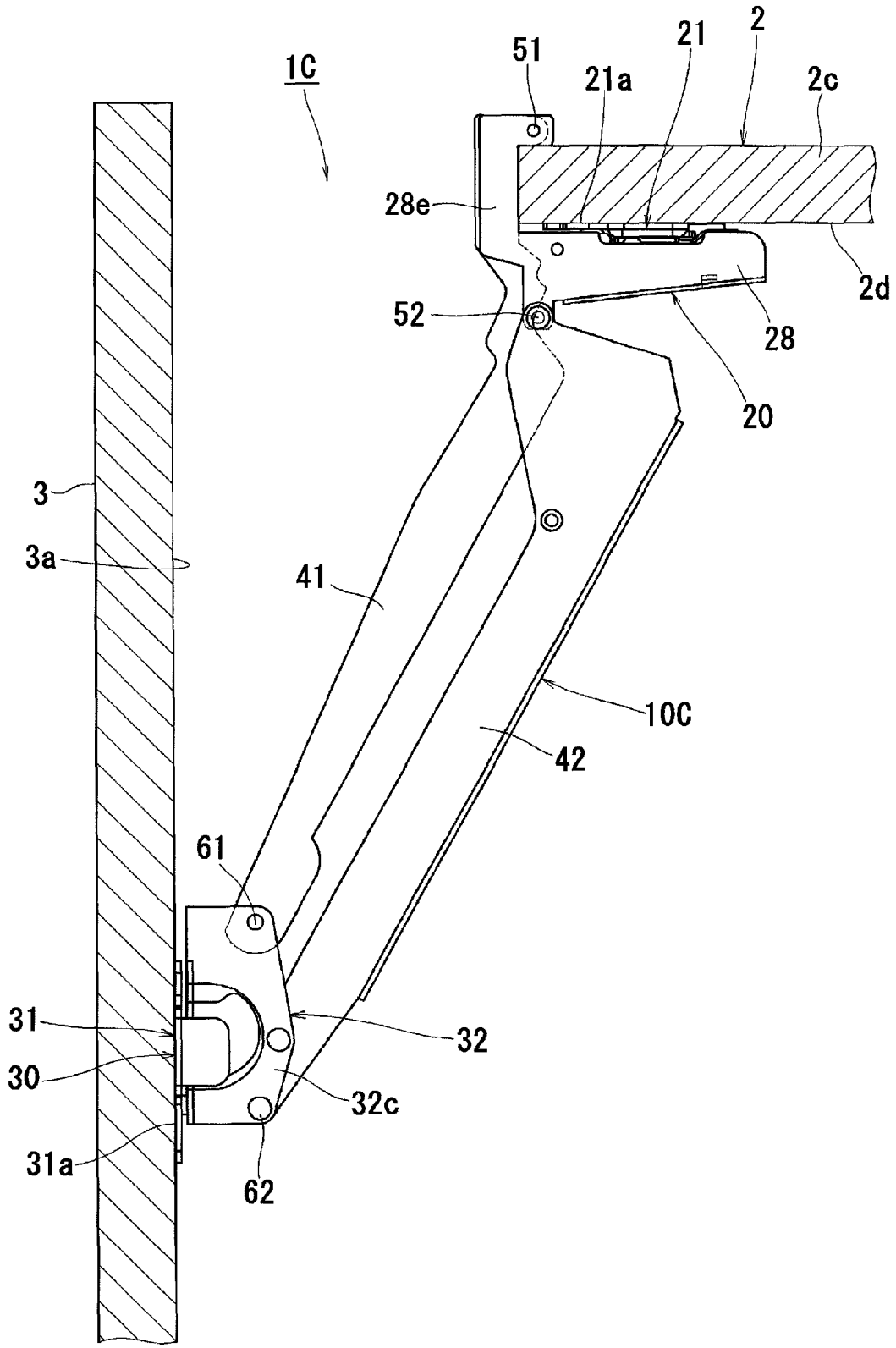
FIG. 27 is a plan cross-sectional view of a main portion of a fourth embodiment of the container apparatus according to the present invention when the door is in the closed position.
Figure 28:
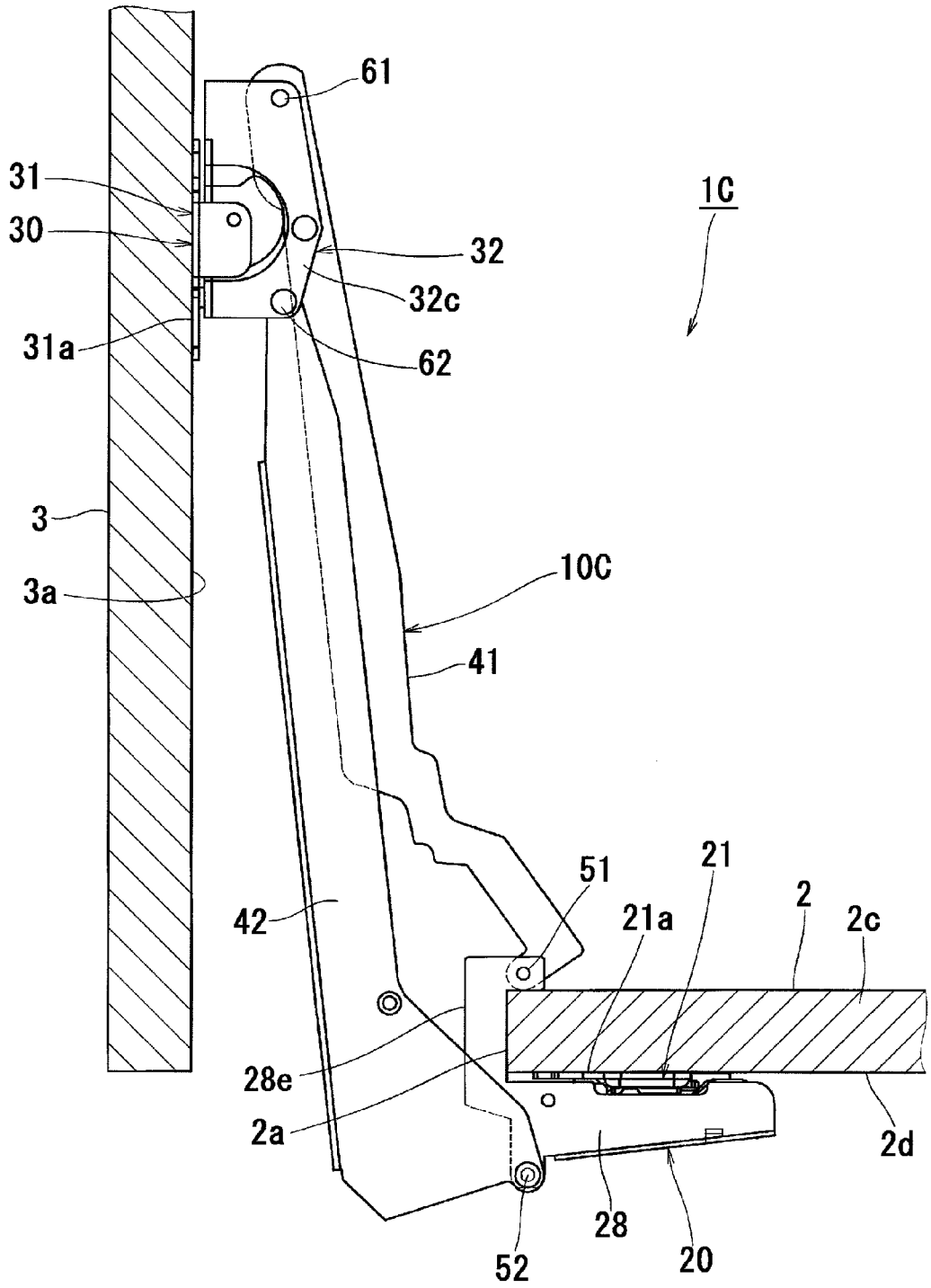
FIG. 28 is a plan cross-sectional view of the main portion of the fourth embodiment when the door is in the open position.

FIGS. 27 and 28 show the fourth embodiment of the present invention. In the container apparatus 1C of this embodiment, a hinge apparatus 10C instead of the hinge apparatus 10B, is used. A protruded portion 28*e* is formed in the front end portion of the connecting member 28 of the hinge apparatus 10C. The protruded portion 28*e* is protruded further forward than the front surface 2*a* and is extended outward along the front surface 2*a* and is extended rearward along the outer surface (outer surface adjacent to the inner side surface 2*d*) of the side wall 2*c*. When the door 3 is rotated from the open position side and reaches the closed position, the third link 41 is abutted against the front surface 2*a* and abutted against the outer surface of the side wall 2*c*. The closed position of the door 3 is determined by the abutment of the third link 41 against the front surface 2*a* and the outer surface of the side wall 2*c*.

The rotation shaft 51 of the third link (first link) 41 is disposed in a distal end portion of the protruded portion 28*e* along the outer surface of the side wall 2*c*. Therefore, the rotation shaft 51 is disposed further behind than the front surface 2*a* in the front-rear direction and disposed further outside than the inner side surface 2*d* in the left-right direction.

In the container apparatus 1*c*, the rotation shaft 51 is disposed further behind than the front surface 2*a*. However, since the rotation shaft 51 is disposed further outside than the inner side surface 2*d*, the rotation shaft 52 can be disposed near the front surface 2*a* as with the third embodiment. Therefore, the utilizable inner space of the housing 2 can be widened.

Figure 29:
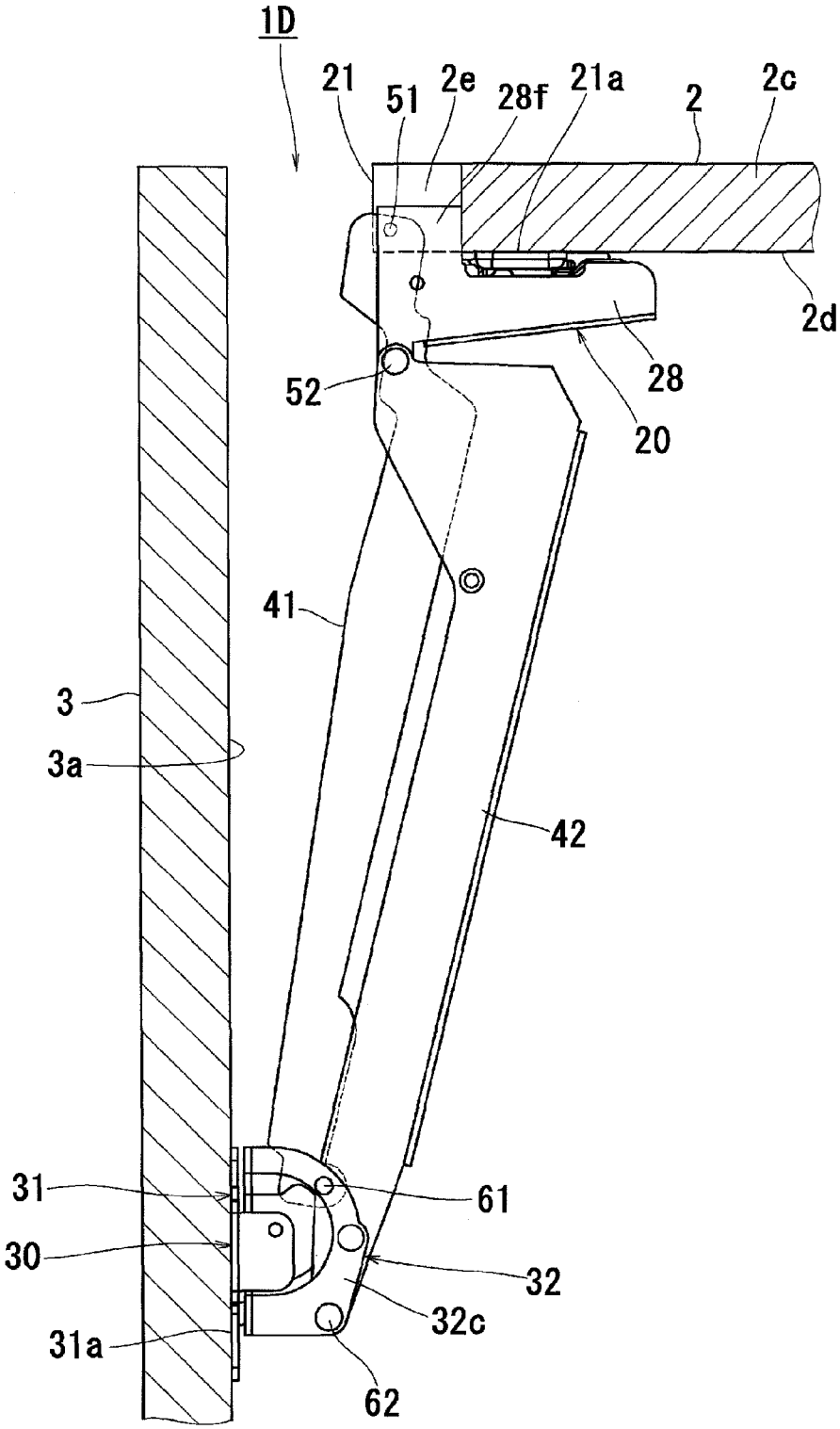
FIG. 29 is a plan cross-sectional view of a main portion of a fifth embodiment of the container apparatus according to the present invention when the door is in the closed position.
Figure 30:
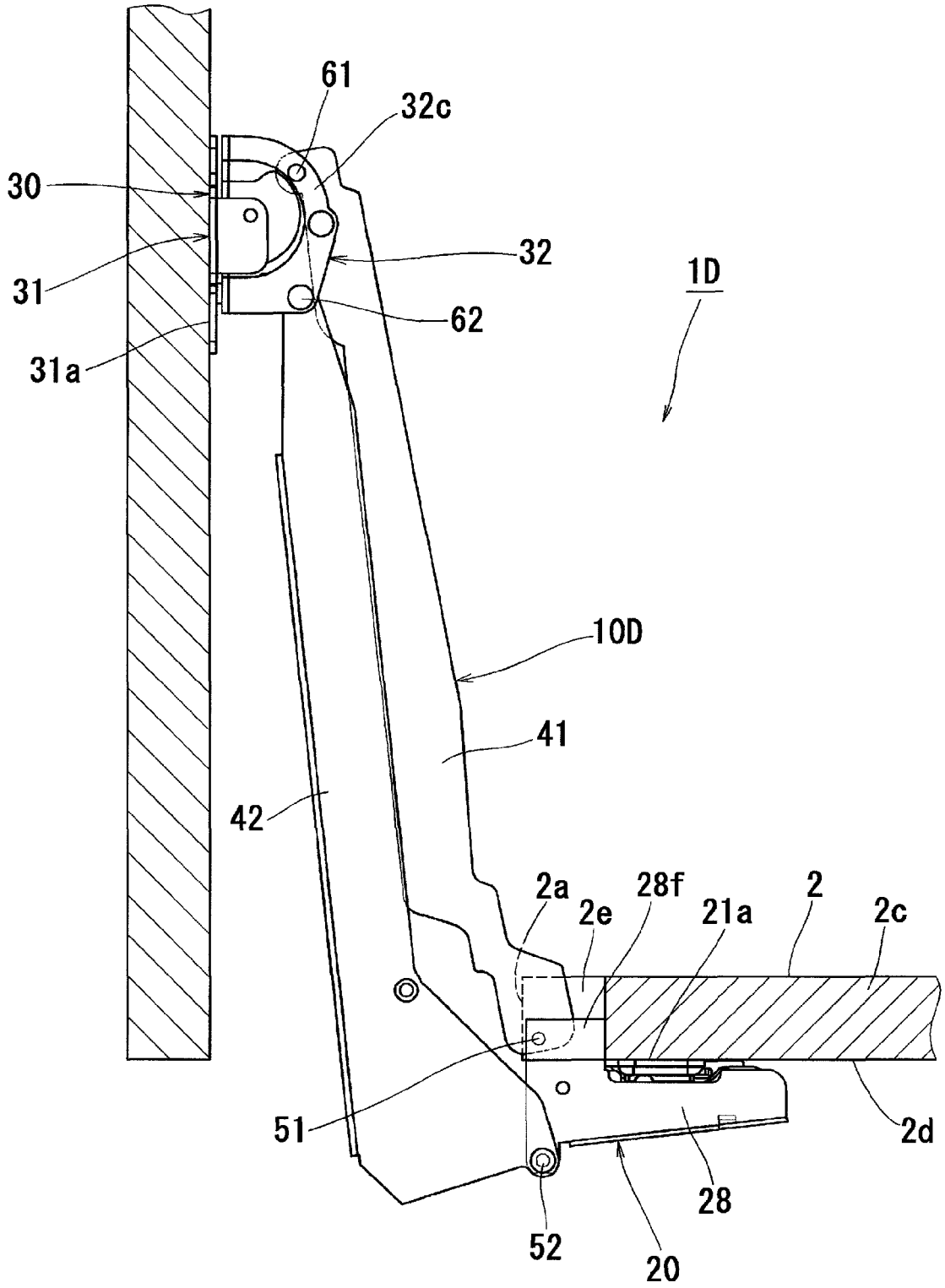
FIG. 30 is a plan cross-sectional view of the main portion of the fifth embodiment when the door is in the open position.

FIGS. 29 and 30 show the fifth embodiment of the present invention. In the container apparatus 1D of this embodiment, a notch portion 2*e* extending through the side wall 2*c* in the left-right direction is formed in the front surface 2*a* of the housing 2. The notch portion 2*e* is disposed at the same position as the connecting member 28 in the top-bottom direction.

A hinge apparatus 10D is used in the container apparatus 1D. A protruded portion 28*f* is formed in the connecting member 28 of the hinge apparatus 10D. The protruded portion 28*f* is disposed in a portion of the front end portion of the connecting member 28 opposed to the notch portion 2*e*. The protruded portion 28*f* is protruded toward outside of the side wall 2*c* and enters inside the notch portion 2*e*. The rotation shaft 51 is disposed in a portion of the protruded portion 28*f* entered inside the notch portion 2*e*. Therefore, the rotation shaft 51 is disposed further outside than the inner side surface 2*d* although the rotation shaft 51 is disposed further behind than the front surface 2*a*.

In this embodiment, the utilizable inner space of the housing 2 can be widened for the same reason as with the third embodiment mentioned above.

Although particular embodiments of the invention have been described in detail for purposes of illustration, various modifications can be made without departing from the spirit and scope of the invention.

For example, while in the embodiments mentioned above, the three links, i.e., the first, the second and the third links 42, 43, 41 are used, only any two of the three links 42, 43, 41 may be used.

Moreover, while in the embodiments mentioned above, the first attachment member 20 is composed of the base plate 21 fixed to the housing 2, the height adjustment member 22 fixed to the base plate 21, the mounting member 23 removably attached to the height adjustment member 22, the disengagement member 26 and the connecting member 28, the first attachment member 20 may be integrally formed if the position adjustment of the connecting member 28 is not required. Alternatively, the first attachment surface may be formed in connecting member 28 and the connecting member 28 may be directly fixed to the housing 2. The same applies to the second attachment member 30. That is, the base part 31 and the support part 32 may be integrally formed. Alternatively, the second attachment surface may be formed in the support part 32 and the support part 32 may be directly fixed to the door 3.

INDUSTRIAL APPLICABILITY

The present invention may be applied to a container apparatus in which a door is connected to a housing by a hinge apparatus including a link mechanism such that the door can be rotated to be opened and closed.

REFERENCE SIGNS LIST

B2 bolt (housing side adjustment mechanism)
1 container apparatus
1A container apparatus
1B container apparatus
1C container apparatus
1D container apparatus
2 housing
2*a* front surface (one end portion outer surface)
2*b* opening
2*d* inner side surface (one side inner surface)
2*e* notch portion
3 door
3*a* rear surface
10 hinge apparatus
10A hinge apparatus
10B hinge apparatus
10C hinge apparatus
10D hinge apparatus
20 first attachment member
21*a* first attachment surface
23*a* screw hole (housing side adjustment mechanism)
28*a* side plate portion (attachment plate portion)
28*b* side plate portion (attachment plate portion)
30 second attachment member
31 base part
31*a* second attachment surface
32 support part
32*b* screw hole (door side adjustment mechanism)
32*d* cam surface (cam portion)
33 adjustment screw (door side adjustment mechanism)
41 third link (first link)
42 first link (second link)
43 second link (third link)
44 spacer
51 rotation shaft (first rotation shaft; rotation center)
52 rotation shaft (second rotation shaft; rotation center)
53 rotation shaft (rotation center)
61 rotation shaft (third rotation shaft; rotation center)
62 rotation shaft (fourth rotation shaft; rotation center)
63 rotation shaft (rotation center)
rotationally biasing means
71 arm
73 roller (movable member)
75 biasing member

The invention claimed is:

1. A hinge apparatus comprising:

a first attachment member to be attached to a housing;

a second attachment member to be attached to a door; and first and second links, respective basal end portions of the first and the second links rotatably attached to the first attachment member, respective distal end portions of the first and the second links rotatably attached to the second attachment member;

wherein the first attachment member comprises:

a base member to be attached to the housing; and a connecting member removably attached to the base member;

wherein the basal end portions of the first and the second links are rotatably attached to the connecting member;

wherein the connecting member, the second attachment member, the first link and the second link constitute a link mechanism, wherein a rotation axis about which the connecting member and the first link rotate is defined as a first rotation axis, wherein a rotation axis about which the connecting member and the second link rotate is defined as a second rotation axis, wherein a rotation axis about which the second attachment member and the first link rotate is defined as a third rotation axis, wherein a rotation axis about which the second attachment member and the second link rotate is defined as a fourth rotation axis, wherein a distance between the first rotation axis and the second rotation axis is equal to a distance between the third rotation axis and the fourth rotation axis, and wherein a distance between the first rotation axis and the third rotation axis is equal to a distance between the second rotation axis and the fourth rotation axis;

wherein the hinge apparatus further comprises a third link that constitutes the link mechanism with the connecting member, the second attachment member, the first link, and the second link;

wherein a fifth rotation axis of a basal end portion of the third link with respect to the connecting member is arranged to form a triangle with the first rotation axis and the second rotation axis, and wherein a rotation axis about which the second attachment member and the distal end portion of the third link rotate is defined as a sixth rotation axis;

wherein the first, the second and the third links are bent in respective intermediate portions; and wherein the bent portions of the first, the second and the third links are positioned on a same side with respect to straight lines connecting respective rotation axes of the respective basal end portions of the first, the second and the third links and respective rotation axes of the respective distal end portions of the first, the second and the third links.

2. A hinge apparatus comprising:

a first attachment member to be attached to a housing;

a second attachment member to be attached to a door; and first and second links, respective basal end portions of the first and the second links rotatably attached to the first attachment member, respective distal end portions of the first and the second links rotatably attached to the second attachment member;

wherein the first attachment member comprises:

a base member to be attached to the housing; and a connecting member removably attached to the base member;

wherein the basal end portions of the first and the second links are rotatably attached to the connecting member;

wherein the connecting member, the second attachment member, the first link and the second link constitute a link mechanism, wherein a rotation axis about which the connecting member and the first link rotate is defined as a first rotation axis, wherein a rotation axis about which the connecting member and the second link rotate is defined as a second rotation axis, wherein a rotation axis about which the second attachment member and the first link rotate is defined as a third rotation axis, wherein a rotation axis about which the second attachment member and the second link rotate is defined as a fourth rotation axis, wherein a distance between the first rotation axis and the second rotation axis is equal to a distance between the third rotation axis and the fourth rotation axis, and wherein a distance between the first rotation axis and the third rotation axis is equal to a distance between the second rotation axis and the fourth rotation axis;

wherein the hinge apparatus further comprises a third link that constitutes the link mechanism with the connecting member, the second attachment member, the first link, and the second link;

wherein a fifth rotation axis of a basal end portion of the third link with respect to the connecting member is arranged to form a triangle with the first rotation axis and the second rotation axis;

wherein the connecting member comprises an attachment plate portion, the basal end portions of the first to the third links rotatably attached to the attachment plate portion;

two links of the first to the third links are disposed on one side of the attachment plate portion and the other link is disposed on the other side of the attachment plate portion; and one link of the two links is disposed generally in contact with the attachment plate portion and the other link is disposed such that the other link is in contact with the attachment plate portion via a spacer having a thickness equal to or greater than a thickness of the one link so that the other link does not interfere with the one link.

3. A hinge apparatus comprising:

a first attachment member to be attached to a housing;

a second attachment member to be attached to a door; and first and second links, respective basal end portions of the first and the second links rotatably attached to the first attachment member, respective distal end portions of the first and the second links rotatably attached to the second attachment member;

wherein the first attachment member comprises:

a base member to be attached to the housing; and a connecting member removably attached to the base member;

wherein the basal end portions of the first and the second links are rotatably attached to the connecting member;

wherein the connecting member, the second attachment member, the first link and the second link constitute a link mechanism, wherein a rotation axis about which the connecting member and the first link rotate is defined as a first rotation axis, wherein a rotation axis about which the connecting member and the second link rotate is defined as a second rotation axis, wherein a rotation axis about which the second attachment member and the first link rotate is defined as a third rotation axis, wherein a rotation axis about which the second attachment member and the second link rotate is defined as a fourth rotation axis, wherein a distance between the first rotation axis and the second rotation axis is equal to a distance between the third rotation axis and the fourth rotation axis, and wherein a distance between the first rotation axis and the third rotation axis is equal to a distance between the second rotation axis and the fourth rotation axis;

wherein the hinge apparatus further comprises a third link that constitutes the link mechanism with the connecting member, the second attachment member, the first link, and the second link;

wherein a fifth rotation axis of a basal end portion of the third link with respect to the connecting member is arranged to form a triangle with the first rotation axis and the second rotation axis;

wherein a housing side adjustment mechanism that adjusts a position of the connecting member with respect to the base member is disposed between the base member and the connecting member; and wherein the second attachment member comprises:

a base part to be attached to the door; and a support part attached to the base part, the distal end portions of the first to the third links rotatably attached to the support part; and a door side adjustment mechanism that adjusts a position of the support part with respect to the base part is disposed between the base part and the support part.

4. A hinge apparatus comprising:

a first attachment member to be attached to a housing;

a second attachment member to be attached to a door; and first and second links, respective basal end portions of the first and the second links rotatably attached to the first attachment member, respective distal end portions of the first and the second links rotatably attached to the second attachment member;

wherein the first attachment member comprises:

a base member to be attached to the housing; and a connecting member removably attached to the base member;

wherein the basal end portions of the first and the second links are rotatably attached to the connecting member;

wherein the connecting member, the second attachment member, the first link and the second link constitute a link mechanism, wherein a rotation axis about which the connecting member and the first link rotate is defined as a first rotation axis, wherein a rotation axis about which the connecting member and the second link rotate is defined as a second rotation axis, wherein a rotation axis about which the second attachment member and the first link rotate is defined as a third rotation axis, wherein a rotation axis about which the second attachment member and the second link rotate is defined as a fourth rotation axis, wherein a distance between the first rotation axis and the second rotation axis is equal to a distance between the third rotation axis and the fourth rotation axis, and wherein a distance between the first rotation axis and the third rotation axis is equal to a distance between the second rotation axis and the fourth rotation axis;

wherein the hinge apparatus further comprises a third link that constitutes the link mechanism with the connecting member, the second attachment member, the first link, and the second link;

wherein a fifth rotation axis of a basal end portion of the third link with respect to the connecting member is arranged to form a triangle with the first rotation axis and the second rotation axis;

wherein a housing side adjustment mechanism that adjusts a position of the connecting member with respect to the base member is disposed between the base member and the connecting member; and wherein the second attachment member comprises:

a base part to be attached to the door; and a support part attached to the base part, the distal end portions of the first and the second links rotatably attached to the support part; and a door side adjustment mechanism that adjusts a position of the support part with respect to the base part is disposed between the base part and the support part.

5. A container apparatus comprising:

a housing having an opening;

a door that opens and closes the opening of the housing; and a hinge apparatus that connects the door to the housing such that the door is moved between a closed position in which the door closes the opening and an open position in which the opening is open, the hinge apparatus comprising:

a first attachment member attached to an inner surface of the housing;

a second attachment member attached to a rear surface of the door; and first and second links, respective basal end portions of the first and the second links rotatably attached to the first attachment member, respective distal end portions of the first and the second links rotatably attached to the second attachment member;

wherein the first attachment member comprises:

a base member attached to the inner surface of the housing; and a connecting member removably attached to the base member;

wherein the basal end portions of the first and the second links are rotatably attached to the connecting member;

wherein the connecting member, the second attachment member, the first link and the second link constitute a link mechanism;

wherein the container apparatus further comprises a third link that constitutes the link mechanism with the connecting member, the second attachment member, the first link, and the second link;

wherein a rotation center of a basal end portion of the third link with respect to the connecting member is arranged to form a triangle with rotation centers of the basal end portions the first and the second links with respect to the connecting member, and wherein a rotation center of a distal end portion of the third link with respect to the second attachment member exists;

wherein the first, the second and the third links are bent in respective intermediate portions; and wherein the bent portions of the first, the second and the third links are positioned on a same side with respect to straight lines connecting respective rotation centers of the respective basal end portions of the first, the second and the third links and respective rotation centers of the respective distal end portions of the first, the second and the third links.

6. A container apparatus comprising:

a housing having an opening;

a door that opens and closes the opening of the housing; and a hinge apparatus that connects the door to the housing such that the door is moved between a closed position in which the door closes the opening and an open position in which the opening is open, the hinge apparatus comprising:

a first attachment member attached to an inner surface of the housing;

a second attachment member attached to a rear surface of the door; and first and second links, respective basal end portions of the first and the second links rotatably attached to the first attachment member, respective distal end portions of the first and the second links rotatably attached to the second attachment member;

wherein the first attachment member comprises:

a base member attached to the inner surface of the housing; and a connecting member removably attached to the base member;

wherein the basal end portions of the first and the second links are rotatably attached to the connecting member;

wherein the connecting member, the second attachment member, the first link and the second link constitute a link mechanism;

wherein the container apparatus further comprises a third link that constitutes the link mechanism with the connecting member, the second attachment member, the first link, and the second link;

wherein a rotation center of a basal end portion of the third link with respect to the connecting member is arranged to form a triangle with rotation centers of the first and the second links with respect to the connecting member; and wherein one of three portions of the connecting member to which the first to the third links are rotatably connected is protruded outside from the opening of the housing; and a recess is formed in the rear surface of the door, the portion of the connecting member protruded from the opening entering into the recess when the door is in the closed position or in the vicinity of the closed position.

7. A container apparatus according comprising:

a housing having an opening;

a door that opens and closes the opening of the housing; and a hinge apparatus that connects the door to the housing such that the door is moved between a closed position in which the door closes the opening and an open position in which the opening is open, the hinge apparatus comprising:

a first attachment member attached to an inner surface of the housing;

a second attachment member attached to a rear surface of the door; and first and second links, respective basal end portions of the first and the second links rotatably attached to the first attachment member, respective distal end portions of the first and the second links rotatably attached to the second attachment member;

wherein the first attachment member comprises:

a base member attached to the inner surface of the housing; and a connecting member removably attached to the base member;

wherein the basal end portions of the first and the second links are rotatably attached to the connecting member;

wherein the connecting member, the second attachment member, the first link and the second link constitute a link mechanism;

wherein the container apparatus further comprises a third link that constitutes the link mechanism with the connecting member, the second attachment member, the first link, and the second link;

wherein a rotation center of a basal end portion of the third link with respect to the connecting member is arranged to form a triangle with rotation centers of the first and the second links with respect to the connecting member;

wherein the connecting member comprises an attachment plate portion, the basal end portions of the first to the third links rotatably attached to the attachment plate portion;

two links of the first to the third links are disposed on one side of the attachment plate portion and the other link is disposed on the other side of the attachment plate portion; and one link of the two link is disposed generally in contact with the attachment plate portion and the other link is disposed such that the other link is in contact with the attachment plate portion via a spacer having a thickness equal to or greater than a thickness of the one link so that the other link does not interfere with the one link.

8. A container apparatus comprising:

a housing having an opening;

a door that opens and closes the opening of the housing; and a hinge apparatus that connects the door to the housing such that the door is moved between a closed position in which the door closes the opening and an open position in which the opening is open, the hinge apparatus comprising:

a first attachment member attached to an inner surface of the housing;

a second attachment member attached to a rear surface of the door; and first and second links, respective basal end portions of the first and the second links rotatably attached to the first attachment member, respective distal end portions of the first and the second links rotatably attached to the second attachment member;

wherein the first attachment member comprises:

a base member attached to the inner surface of the housing; and a connecting member removably attached to the base member;

wherein the basal end portions of the first and the second links are rotatably attached to the connecting member;

wherein the connecting member, the second attachment member, the first link and the second link constitute a link mechanism;

wherein the container apparatus further comprises a third link that constitutes the link mechanism with the connecting member, the second attachment member, the first link, and the second link;

wherein a rotation center of a basal end portion of the third link with respect to the connecting member is arranged to form a triangle with rotation centers of the first and the second links with respect to the connecting member;

wherein a housing side adjustment mechanism that adjusts a position of the connecting member with respect to the base member is disposed between the base member and the connecting member; and wherein the second attachment member comprises:

a base part to be attached to the door; and a support part attached to the base part, distal end portions of the first to the third links rotatably attached to the support part; and a door side adjustment mechanism that adjusts a position of the support part with respect to the base part is disposed between the base part and the support part.

9. A container apparatus comprising:

a housing having an opening;

a door that opens and closes the opening of the housing; and a hinge apparatus that connects the door to the housing such that the door is moved between a closed position in which the door closes the opening and an open position in which the opening is open, the hinge apparatus comprising:

a first attachment member attached to an inner surface of the housing;

a second attachment member attached to a rear surface of the door; and first and second links, respective basal end portions of the first and the second links rotatably attached to the first attachment member, respective distal end portions of the first and the second links rotatably attached to the second attachment member;

wherein the first attachment member comprises:

a base member attached to the inner surface of the housing; and a connecting member removably attached to the base member;

wherein the basal end portions of the first and the second links are rotatably attached to the connecting member;

wherein the connecting member, the second attachment member, the first link and the second link constitute a link mechanism;

wherein a housing side adjustment mechanism that adjusts a position of the connecting member with respect to the base member is disposed between the base member and the connecting member; and wherein the second attachment member comprises:

a base part to be attached to the door; and a support part attached to the base part, the distal end portions of the first and the second links rotatably attached to the support part; and a door side adjustment mechanism that adjusts a position of the support part with respect to the base part is disposed between the base part and the support part.

10. A hinge apparatus comprising:

a first attachment member having a flat first attachment surface;

first and second links, basal end portions of the first and the second links rotatably connected to the first attachment member such that respective basal end portions of the first and the second links are rotatable about a first rotation shaft and a second rotation shaft parallel to the first rotation shaft; and a second attachment member having a flat second attachment surface, distal end portions of the first and the second links being connected to the second attachment member such that the first and the second links are respectively rotatable about third and fourth rotation shafts parallel to the first and second rotation shafts, thereby connecting the second attachment member to the first attachment member via the first and the second links such that the second attachment member is rotated between a closed position and an open position;

when the second attachment member is in the closed position, an angle between the first attachment surface and the second attachment surface being generally a right angle, the first to the fourth rotation shafts being positioned on a same side of the second attachment member with respect to the first attachment surface, and the third and the fourth rotation shafts being more distanced from the first attachment surface than the first and the second rotation shafts;

wherein when the second attachment member is in the closed position, an entirety or substantially all of the first attachment surface is positioned on a back side of the second attachment surface and at least one of the first and the second rotation shafts is positioned on a front side of the second attachment surface.

11. A hinge apparatus comprising:

a first attachment member having a flat first attachment surface;

first and second links, basal end portions of the first and the second links rotatably connected to the first attachment member such that the respective basal end portions of the first and the second links are respectively rotatable about a first rotation shaft and a second rotation shaft parallel to the first rotation shaft; and a second attachment member having a flat second attachment surface, distal end portions of the first and the second links being connected to the second attachment member such that the first and the second links are respectively rotatable about third and fourth rotation shafts parallel to the first and second rotation shafts, thereby connecting the second attachment member to the first attachment member via the first and the second links such that the second attachment member is rotated between a closed position and an open position;

when the second attachment member is in the closed position, an angle between the first attachment surface and the second attachment surface being generally a right angle, the first to the fourth rotation shafts being positioned on a same side of the second attachment member with respect to the first attachment surface, and the third and the fourth rotation shafts being more distanced from the first attachment surface than the first and the second rotation shafts;

wherein the first rotation shaft and the second rotation shaft are disposed such that when the second attachment member is in the closed position, one of the first rotation shaft and the second rotation shaft is positioned on a front side of the second attachment surface and the other of the first rotation shaft and the second rotation shaft is positioned on a back side of the second attachment surface.

12. A container apparatus comprising:

a housing having an opening formed in an one end portion outer surface of the housing; and a door connected to the housing via a hinge apparatus such that the door is rotated between a closed position and an open position;

the hinge apparatus comprising:

a first attachment member attached to an inner surface of the housing at a portion near the one end portion outer surface of an one side inner surface of the inner surface of the housing;

first and second links, basal end portions of the first and the second links rotatably attached to the first attachment member such that the respective basal end portions of the first and the second links are rotatable about a first rotation shaft and a second rotation shaft parallel to the first rotation shaft; and a second attachment member attached to a rear surface of the door and connecting the door to the housing such that the door is rotated between the closed position and the open position, the second attachment member being connected to respective distal end portions of the first and the second links such that the second attachment member is rotated about third and fourth rotation shafts parallel to the first and the second rotation shafts;

the first attachment member being attached to the one side inner surface, when the door is in the closed position, the second attachment member being positioned nearer to the other side inner surface opposed to the one side inner surface than the first attachment member in a direction from the one side inner surface to the other side inner surface;

wherein at least one of the first and the second rotation shafts are disposed outside of the housing.

13. The container apparatus according to claim 12 wherein at least one of the first and the second rotation shafts are disposed further in front than the one end portion outer surface of the housing, the opening formed in the outer surface.

14. The container apparatus according to claim 13 wherein when the door is in the closed position, the rear surface of the door is abutted against the one end portion outer surface of the housing, the opening formed in the one end portion outer surface; and a recess is formed in the rear surface of the door, the first rotation shaft being received in the recess in an extendable and retractable manner when the door is in the closed position.

15. The container apparatus according to claim 12 wherein at least one of the first and the second rotation shafts are disposed further outside than the one side inner surface of the housing, the first attachment member attached to the one side inner surface.

16. The container apparatus according to claim 12 wherein at least one of the first and the second rotation shafts are disposed further outside than an outer surface adjacent to the one side inner surface of the housing, the first attachment member attached to the one side inner surface.

17. The container apparatus according to claim 12 wherein a notch portion is formed in an intersecting portion of the one end portion outer surface of the housing and the one side inner surface of the housing, the opening formed in the one end portion outer surface, the first attachment member attached to the one side inner surface; and wherein at least one of the first and the second rotation shafts are disposed inside the notch portion.

* * * * *